US005402702A

United States Patent [19]

Hata

[11] Patent Number: 5,402,702

[45] Date of Patent: Apr. 4, 1995

[54] TRIGGER CIRCUIT UNIT FOR OPERATING LIGHT EMITTING MEMBERS SUCH AS LEDS OR MOTORS FOR USE IN PERSONAL ORNAMENT OR TOY IN SYNCHRONIZATION WITH MUSIC

[75] Inventor: Shuji Hata, Tokyo, Japan

[73] Assignee: Jalco Co., Ltd., Tokyo, Japan

[21] Appl. No.: 913,198

[22] Filed: Jul. 14, 1992

[51] Int. Cl.[6] ..... G10G 7/00

[52] U.S. Cl. ..... 84/464 R; 446/175

[58] Field of Search ..... 84/464 A, 464 R; 446/298, 300, 175, 299

[56] References Cited

U.S. PATENT DOCUMENTS

| | | | |
|---|---|---|---|
| 4,889,027 | 12/1989 | Yokoi | 84/635 |
| 4,928,568 | 5/1990 | Snavely | 84/464 R |
| 4,949,327 | 8/1990 | Forsse et al. | 446/301 |
| 5,013,276 | 5/1991 | Garfinkel . | |
| 5,040,319 | 8/1991 | Wang et al. . | |
| 5,056,399 | 10/1991 | Hornstein | 84/464 R |
| 5,074,821 | 12/1991 | McKeefery et al. | 446/299 |
| 5,090.936 | 2/1992 | Satoh et al. . | |
| 5,108,341 | 4/1992 | DeSmet | 446/299 |

*Primary Examiner*—William M. Shoop, Jr.
*Assistant Examiner*—Jeffrey W. Donels
*Attorney, Agent, or Firm*—Rogers & Killeen

[57] ABSTRACT

A trigger circuit unit including: a forward circuit block having a pickup circuit such as a microphone for picking up a signal of music so as to convert it into an electric signal; a filter circuit for selecting a portion of the band from a picked up audible frequency band; and a limit amplifier circuit mainly composed of an inverter operation logic IC for amplifying the selected electric signal having a portion of the band and transmitting an output having a predetermined amplitude; and a waveform conversion circuit block having a time constant circuit connected to the output of the forward circuit block and composed of a capacitor having one or more diodes connected in series and a resistor in order to prevent a backflow and to obtain a forward directional voltage difference, wherein analog pulse signals transmitted from the time constant circuit are caused to perform a Schmidt operation having a previously adjusted degree of hysteresis, wherein the rectangular pulse signals transmitted from the waveform conversion circuit block in accordance with the electric signals which correspond to the music signals each having a partial band picked up, selected and amplified in the forward circuit block are transmitted as basic trigger signals for operating light emitting members such as LEDs or motors.

28 Claims, 13 Drawing Sheets

TRIGGER CIRCUIT UNIT FOR OPERATING LIGHT EMITTING MEMBERS SUCH AS LEDS OR MOTORS FOR USE IN PERSONAL ORNAMENT OR TOY IN SYNCHRONIZATION WITH MUSIC

BACKGROUND OF THE INVENTION

1. Field of the Invention

The present invention relates to a trigger circuit and an operating circuit formed into a unit for transmitting a trigger electric signal in synchronization with the timing of signals of medium or low frequency sounds such as a drum or vocal which constitute the main portion of played or broadcasted music and which are selected from the overall frequency components included in the music so as to operate a light emitting member such as LEDs or a motor for use in a personal ornament or a toy in synchronization with the above-mentioned music.

2. Related Art

Hitherto, an apparatus for switching on/off a switch such as a power supply switch or an apparatus for flashing light emitting devices such as lights have been known.

The conventional apparatuses so arranged to be operated in response to music are classified into two types depending upon their way of operations to be performed in response to the sound. One of the two types has an arrangement made that an operation for actuating light emitting members such as LEDs or motors is caused to be performed in response to switching on/off signals electrically generated in accordance with information about a fact whether or not sound of music is present or a fact whether or not sound having a level higher than a predetermined level is present. When the aforesaid operation has been commenced, the light flashing operation or the like is simply performed in a predetermined time in accordance with a specific period given to an operating circuit for actuating light emitting members or the like regardless of the presence of the sound or the like. The above-mentioned type is called a "response type" hereinafter.

Another type is so arranged that the progress of operation is not given any specific period but the operation of the operating circuit for actuating a light emitting members or the like is performed at the timing of the supplied switching on/off signals electrically generated in accordance with change in information about sound such as music. That is, the aforesaid type is so arranged to be operated in real time in accordance with the change in the sound, namely, it is operated in synchronization with the change in the sound in a way called a "synchronization type" hereinafter.

A variety of apparatuses of the type classified into the aforesaid two types have been supplied to the market while being varied in terms of the structure arranged from a simple structure to a complicated structure to meet the purpose of the use, desired function or the cost. For example, in a karaoke playing room or a discotheque, the atmosphere is enlived or a visual effect is staged by using the aforesaid synchronization type or the response type apparatus so as to flash lights or rotate the motor for rotary lights. As a result, light beams emitted and/or rotated together with the music is used to audibly or visually appeal to human beings.

In order to enchant or excite a user of a toy or to differentiate the competitive products, many products each of which is arranged to generate sound or include light emitting devices have been put on the market. Therefore, a simple apparatus of the response type so arranged that light response to sound of music or the like has been used.

A personal ornament such as a badge arranged in such a manner that an LED is simply flashed by switching off a switch has been known. However, a product having an arrangement made that the light emitting member such as an LED is actuated in response to the sound of music has not been put into practical use because the space required to accommodate a circuit has not been kept in both of the synchronization type and the response type.

Then, the aforesaid response type apparatus and the synchronization type apparatus will now be described.

FIG. 13 is a functional block diagram which illustrates an example of the conventional response-type apparatus so arranged that a light emitting member such as an LED or a motor is operated in response to the sound of music. Referring to FIG. 13, reference numeral 41 represents a pickup circuit having a microphone MC, 42 represents an amplifier circuit, 43 represents a wave detecting circuit, 44 represents a time constant circuit, 45 represents an output circuit, 46 represents a constant time holding circuit, 47 represents a power supply such as a battery connected to each of circuit blocks so as to supply electricity to the same. Reference numeral 48 represents a device to be operated which is a motor according to this example. Referring to FIG. 13, symbol Sud represents the sound of music surrounding the microphone Mc, range S surrounded by an alternate long and short dash line is a block for processing signals, and range T surrounded by a dashed line is a timing generating block. Symbol OUT represents a signal output point and SW represents a power supply switch.

In the apparatus shown in FIG. 13, when the surrounding sound of music is transmitted to the pickup circuit 41 having the microphone Mc, the sound is converted into a weak electric signal (hereinafter called a "weak signal"), the weak signal being then supplied to the ensuing amplifier circuit 42. The amplifier circuit 42 so suitably amplifies the supplied signal to make a music signal which is then supplied to the ensuing wave detecting circuit 43. The wave detecting circuit 43 detects the wave of the music signal so as to convert it into a DC electric signal which is a signal to be supplied to the ensuing time constant circuit 44. The time constant circuit 44 is an integrating type time constant circuit composed of a capacitor and a resistor which is used mainly and arranged to integrate the supplied electric signal so as to convert it into a DC voltage level in order to supply it to the output circuit 45.

The aforesaid DC voltage level is made to be a level whereby the output circuit 45 can be actuated if there is the music signal, causing a turning-on signal (hereinafter called an "ON signal") for actuating the device 48 to be operated is transmitted to the signal output point OUT. If there is not music signal, a turned-off state where no turning-on signal is transmitted is realized.

In the apparatus shown in FIG. 13, the integration time in the time constant circuit 44 must be lengthened sufficiently with respect to the lowest frequency of the supplied music in order to cause the ON signal to be assuredly obtained at the signal output point OUT. The reason for this lies in that, if the aforesaid integration time is shorter than one period of the lowest frequency, the change in the amplitude of the frequency is substantially directly transmitted as the output from the time constant circuit 44 to the signal output circuit 45 and therefore an unstable ON signal is transmitted to the signal output point OUT. If the integration time is too long, a defective integration of solely generated short sound takes place and therefore the level of the output DC voltage from the time constant circuit 44 becomes lowered. As a result, a problem of an insensitive state taken place in which no ON signal is transmitted to the signal output point OUT.

Accordingly, the conventional apparatus shown in FIG. 13 is so arranged that a portion of the output from the output circuit 45 is caused to be supplied to the constant time holding circuit 46 and as well as the aforesaid short integration time is set to the time constant circuit 44. As a result, if an unstable signal to be transmitted to the signal output point OUT is present, the constant time holding circuit 46 transmits voltage, with which the ON signal to be transmitted to the signal output point OUT can be forcibly made to be reliable, to the time constant circuit 44 and the amplifier circuit 42 in order to prevent the aforesaid insensitive state.

The conventional apparatus shown in FIG. 13 is sometimes actually arranged to have a circuit constituted in such a manner that the characteristics of a semiconductor such as a transistor for use in the amplifier circuit 42 are used to simultaneously perform the amplifying operation and the wave detecting operation which is arranged to be performed by the wave detecting circuit 43 included in the functional block shown in FIG. 13. Furthermore, a capacitor for use in the time constant circuit 44 and that for use in the constant time holding circuit 46 are replaced by a common capacitor. In addition, the integrating resistor or the like for use in the time constant circuit 44 is substituted by a conducting resistance included by the semiconductor such as a transistor. As a result, the number of the devices required to constitute the wave detecting circuit 43 and the time constant circuit 44 is decreased in order to, for example, balance the function with the cost in a case where the apparatus is used in a low cost product such as a toy.

However, the presence of the aforesaid constant time holding circuit 46 will cause the ON signal to be transmitted to the signal output point OUT during the operation of the constant time holding circuit 46 regardless of the timing of punctuating sound (for example, sound expressing the tempo of music created by a rhythm instrument) which is audible for a human being and which is included by the music if the punctuating sound is included by the sound components of the supplied music. The reason for this will now be described. Even if the holding operation of the constant time holding circuit 46 is completed after a predetermined time has passed, the probability that the completion timing and the aforesaid punctuating sound align to each other is low. The following operations are repeated: the output from the wave detecting circuit 43 applied to the time constant circuit 44 at the completion timing causes the ON signal to be transmitted to the-signal output point OUT and the constant time holding circuit 46 is again operated.

As a result, the operation of the device to be operated by the above-mentioned apparatus, that is, the rotation of the motor or the flashing of the light emitting member such as an LED is performed substantially discontinuously. Therefore, a problem arises in that the aforesaid operation of the motor or the light emitting member cannot coincide with the sound of music while realizing a state of the rotation or the flashing without variety.

In order to overcome the above-mentioned problem, the conventional apparatus has been arranged to have, for example, a means for converting the rotation of the rotational shaft of the motor or the like into a complicated motion by using mechanical elements such as gears and/or cams so as to complement the aforesaid unsatisfactory operation. However, the operation thus arranged is actually a simple false operation realized by utilizing the optical illusion so as to cause the person to feel that the operation coincides with the sound of music. On the contrary, another problem arises in that the number of the aforesaid mechanical elements increases and the structure becomes complicated. This problem also arises if the device to be operated is substituted from the motor or the like to a solenoid or the like.

In order to overcome the problem taken place in that information obtainable from the auditory sense and information obtainable from the visual sense cannot be matched to each other, there is an apparatus to which another circuit is added in the rear portion thereof so as to make the state of flashing of a plurality of light emitting devices such as LEDs to be seen as if random flashing is being performed. That is, the optical illusion is utilized so as to cause a person to feel that the synchronization type operation is being performed.

FIG. 14 is a functional block diagram which illustrates another example of a conventional apparatus which is an improvement in the aforesaid basic conventional apparatus shown in FIG. 13. Referring to FIG. 14, the same reference numerals as those shown in FIG. 13 represent the same functional blocks. Referring to FIG. 14, reference numeral 49 represents an output operation pattern generating circuit (hereinafter abbreviated to a "pattern circuit") having a plurality of output circuits, and 50*a* to 50*n* represent oscillating circuits (hereinafter abbreviated to "OSC") each having a specific frequency transmitting function. Symbols A to N respectively represent the specific output frequencies. Reference numerals 48*a* to 48*h* represent devices to be operated and are light emitting members such as LEDs in the structure shown in FIG. 14. Range P surrounded by an alternate long and two short dashes line is a range for a pattern generating block. Symbols OUTa to OUTn represent signal output points through which outputs from a plurality of output circuits included in the pattern circuit 49 are transmitted. As shown in FIG. 14, the pattern generating block P is connected to the portion next to the signal output point OUT of the aforesaid conventional circuit shown in FIG. 13. Therefore, the pattern generating block P will now be described.

The pattern circuit 49 is composed of a logic IC or the like comprising a counter, a shift register, a decoder and the like. The term "pattern" used hereinbefore is collectively meant a difference between bit outputs which is, in a case of the counter, a value of the result of the binary operation transmitted at every binary counting operation of clock signals for the upward operation or the downward operation, which is a value of the result of the binary operation transmitted at every shifting operation when a binary data signal is shifted to right or left in a case of the shift register, and which is a value of the result of another binary operation obtainable by code-converting the value of the result of the binary operation transmitted from the counter or the shift register in a case of the decoder.

As the clock signals for operating the aforesaid logic IC or the like and signals for changing the operations (for example, changing the count increasing operation to the decreasing operation), the specific frequencies A to N are always transmitted from the corresponding OSC 50*a* to 50*n* to the IC or the like of the pattern circuit 49. As a result of the constitution thus arranged, the pattern circuit 49 attempts to generate the pattern in accordance with the difference between the frequency outputs from the OSC 50*a* to 50*n* and to transmit the pattern to the signal output points OUTa to OUTn. However, since, the IC or the like of the pattern circuit 49 has functions of enabling the operation to be performed and cancelling the reset and includes terminals (for example, an output enable terminal or a terminal capable of cancelling the reset) for controlling these function, the output of the pattern to the signal output points OUTa to OUTn is commenced when a proper logic signal is supplied to the above-mentioned terminal, for example, the reset cancelling terminal, so that the devices 48*a* to 48*n* (a plurality of light emitting members such as LEDs) are operated. The pattern generating block P has an arrangement capable of solely operating the devices to be operated in accordance with the pattern when a proper logic signal is supplied to the above-mentioned control terminal thereof.

By bringing the pattern generating block P into an initial state where the resetting is continued in a normal condition in the above-mentioned operation state while using the reset cancelling terminal as the control terminal and supplying the ON signal which is a signal to be transmitted from the aforesaid signal processing block S to the signal output point OUT and which is formed in accordance with the holding time of the constant time holding circuit 46 to perform the control, the aforesaid reset continuation state is cancelled. Therefore, the devices to be operated can be operated while having the pattern during the period in which the ON signal is supplied. Furthermore, the initial state is then restored if the supply of the ON signal is stopped.

With the improved-type conventional apparatus shown in FIG. 14, in a short time of the observation, the state where the light emitting members such as LEDs flash can be sometimes seen for persons as if each light emitting member randomly flashes in synchronization with the sound of music due to illusion. However, if the state of flashing or the like is observed for a somewhat long time, it can be apparently recognized that the flashing timing does not coincide with the sound of music because the structure is constituted basing upon the above-mentioned conventional apparatus. Therefore, the problem of the monotonous operation cannot be overcome. Furthermore, the number of elements required to constitute the apparatus increases as compared with the basic conventional apparatus, causing a problem to arise in that the cost cannot be reduced. What is worse, a wide space must be used to constitute the circuit, causing another problem to arise in that the size of the apparatus cannot be easily reduced. The reaction type conventional apparatus is typically summarized as described above.

On the other hand, there has been an apparatus among the synchronization type conventional apparatuses that is constituted by simplifying a complicated and high price conventional apparatus for use in a discotheque so as to be easily privately used. The apparatus of the aforesaid type is so arranged that light emitting members such as lights are flashed in synchronization with the sound of music in accordance with information about the frequency component included in the sound of music.

FIG. 15 is a functional block diagram which illustrates the synchronization-type conventional apparatus so arranged that the light emitting members such as lights are flashed in accordance with information about the frequency component included in the sound of music. Referring to FIG. 15, the same reference numerals as those shown in FIGS. 13 and 14 represent the same functional blocks. Referring to FIG. 15, reference numeral 60L represents a low-pass filter, 61 represents a voltage comparison circuit and 62 represents a determined reference voltage serving as a reference for use in the voltage comparison circuit 61. The aforesaid elements constitute a functional block for channels corresponding to the low frequency levels of the sound. Reference numeral 60B represents a band-pass filter, 60B' represents another band-pass filter arranged to have the same structure as that of the band-pass filter 60B but arranged to act with respect to a different frequency band. Reference numeral 60H represents a high-pass filter. Each of the aforesaid filters has, in the rear portion thereof, the same functional block as that of the aforesaid block and a block for flashing a light emitting member such as a light which corresponds to each frequency. Range Ch surrounded by a dashed line is a flashing function block Ch having the band-pass filter 60B so as to function to flash the light in response to the medium or low frequency of the sound of music. Symbol OUTz represents a signal output point of the aforesaid block Ch.

When the surrounding sound of music is transmitted to the pickup circuit 41 having a microphone MC of the functional block shown in FIG. 15, the sound thus transmitted is converted into a weak signal. The weak signal is transmitted to the low-pass filter 60L, the band-pass filters 60B and 60B' arranged to pass different bands and the high-pass filter 60H so as to be classified into frequency bands set to the corresponding filters. Since the weak signal has been damped by the AC resistor components L, C and R which are the components of the aforesaid filters as the compared with the level at the time of the transmission, the weak signal is amplified at a relatively high amplification ratio by each of the amplifier circuits 42 respectively subsequently connected to the filters 60L, 60B, 60B' and 60H. The output from each of the amplifier circuits 42 is passed through each wave detecting circuit 43 so as to be converted into a DC component, and then it is converted into a DC voltage level by each of the subsequent time constant circuits 44.

The level of the output voltage from each of the time constant circuits 44 is raised as the frequency of the transmitted weak signal approaches the central frequency of each of the filters 60L, 60B, 60B' and 60H set by the filters disposed before two stages. That is, if there is a frequency, which is near the central frequency of each of the aforesaid filters, in all of the frequency components contained in the music, the output voltage from the time constant circuit 44 is raised.

The output voltage from each of the time constant circuit 44 is supplied to each of the subsequent voltage comparison circuit 61 so as to be subjected to a comparison with the determined reference voltage 62. If the level of the output voltage is higher than the level of the reference voltage, the corresponding output circuit 45 is actuated so that the corresponding device 48 to be operated such as the light is operated.

Therefore, the synchronization type conventional apparatus is arranged to flash the devices 48 such as lights to be operated in accordance with the determined central frequency of each of the filters set to the frequency band of the sound of music such as drums or vocal. Since the filter employed in an apparatus of the aforesaid type has a characteristic of about −6 dB/oct in a case of a general type filter, the range can be set, at the very finest, to a degree obtainable by dividing the audible frequency range (about 20 Hz t 20 KHz) for a human being into three sections (the number of the sections is the same as the number of lights or light groups to be flashed) if there is a requirement that the lights can be reliably flashed. Therefore, the state of flashing of the lights caused by the overall actions of, for example, the four channels shown in FIG. 15 become somewhat satisfactory in terms of the synchronization with the sound of music but the realized sound is unsatisfactory in terms of the modulation.

However, if the state of the output made at the signal output point OUTz of the synchronization type conventional apparatus shown in FIG. 15 and that made at the signal output point OUT of the conventional response type apparatus shown in FIG. 13 are subjected to a comparison while limitedly observing one channel of a block Ch acting to flash the light by means of the bandpass filter 60B in response to the medium or low frequency band of the sound of music, the signal output point OUTz in the circuit structure of the block Ch limited to one channel in the synchronization type conventional apparatus shown in FIG. 15 displays superior response. Furthermore, an excellent output while exhibiting modulations can be obtained because the operation is performed in synchronization with the sound of music.

Therefore, the unsatisfactory operation of the conventional response type apparatus can be overcome by substituting the circuit of the basic response type conventional apparatus shown in FIG. 13 or that of another response type conventional apparatus shown in FIG. 14 by the block Ch shown in FIG. 15. However, the filter circuit, the voltage comparison circuit and the circuit for use in a portion for setting the reference voltage must be additionally provided. Therefore, the number of required elements is substantially doubled, causing the problem of the difficulty of reducing the cost and necessity of providing a space for accommodating required elements to become more critical as compared with the conventional response type apparatus. Therefore, the size reduction becomes more difficult to be realized. As a result, the apparatus of the aforesaid type cannot be employed in a toy or the like.

A synchronization type conventional apparatus capable of overcoming the problems experienced with the aforesaid conventional apparatuses, decreasing the number of required elements and reducing the cost has been disclosed. That is, the inventor of the present invention has disclosed an invention titled as "DECORATIVE LIGHT HAVING PLL CIRCUIT AND EMITTING LIGHT IN SYNCHRONIZATION WITH MUSIC" (Japanese Patent Application No. 3-278685). Similarly to the conventional apparatus which has been improved as described above, the above-mentioned apparatus is able to perform the operation more satisfactorily as compared with the conventional apparatus because of an arrangement made that limiting to one channel of a multiplicity of channels (the block for turning on a light) is made.

However, the conventional apparatus employing a portion of the apparatus which utilizes the PLL circuit for the purpose of making an improvement encounters a practical problem taken place in that the capacity of a capacitor or the like is inevitably enlarged and therefore the overall size becomes enlarged because of the necessity lying in constituting the circuit even if an IC exclusive element is used to constitute the required amplifier circuit. On the other hand, the conventional apparatus having no PLL circuit arises a problem in that the cost and the size cannot be reduced due to the aforesaid problems and the practical problem which takes place when the abovementioned amplifier circuit is used.

SUMMARY OF THE INVENTION

Accordingly, an object of the present invention is to provide a trigger circuit unit for operating light emitting members such as LEDs or motors for use in a personal ornament of a toy in synchronization with the sound of music, which is capable of overcoming the above-mentioned various problems experienced with the conventional apparatus for operating light emitting members such as LEDs or motors in response to the sound of music for use in a toy or the like. In order to achieve this, the present invention is arranged to be able to accurately actuate the device to be operated in accordance with the synchronization type operation to be performed in synchronization with the sound of music, while meeting the following requirements:

The size must be so made as to be employed in a relatively small personal ornament such as a badge.

The devices to be operated can be actuated while exhibiting excellent modulation (the flashing operation of the light emitting devices such as LEDs) in accordance with information about the sound of music.

An element having a very small size (for example, a small volume element such as a chip type capacitor) can be employed as the elements for constituting the circuit.

The number of required elements to be mounted on the circuit can be considerably decreased.

The trigger circuit unit must be treated as one small unit which does not require a large space.

The starting operation (trigger operation) of the conventional response type apparatus can be as well as performed and a substitution by the conventional apparatus can be performed.

In order to achieve the aforesaid object, according to one aspect of the present invention, there is provided a trigger circuit unit including: a forward circuit block having a pickup circuit such as a microphone for picking up a signal of music so as to convert it into an electric signal; a filter circuit for selecting a portion of the band from a picked up audible frequency band; and a limit amplifier circuit mainly composed of an inverter operation logic IC for amplifying the selected electric signal having a portion of the band and transmitting an output having a predetermined amplitude; and a waveform conversion circuit block having a time constant circuit connected to the output of the forward circuit block and composed of a capacitor having one or more diodes connected in series and a resistor in order to prevent a backflow and to obtain a forward directional voltage difference, the time constant circuit being arranged to form electric signals, the level of each of which is higher than a predetermined level, into analog pulse signals while making the voltage after it has been dropped and which can be obtained from the forward directional voltage difference of the diodes to be a reference when the electric signal supplied from the forward circuit block passes through the time constant circuit so as to transmit the analog pulse signal, wherein the analog pule signals transmitted from the time constant circuit are caused to perform a Schmidt operation having a previously adjusted degree of hysteresis in a Schmidt circuit mainly composed of an inverter operation logic IC connected subsequently so as to be shaped and converted into a rectangular pulse signals before they are transmitted, wherein the rectangular pulse signals transmitted from the waveform conversion circuit block in accordance with the electric signals which correspond to the music signals each having a partial band picked up, selected and amplified in the forward circuit block are transmitted as basic trigger signals for operating light emitting members such as LEDs or motors. Other and further objects, features and advantages of the invention will be appear more fully from the following description.

DETAILED DESCRIPTION OF THE PREFERRED EMBODIMENTS

Figure 1:
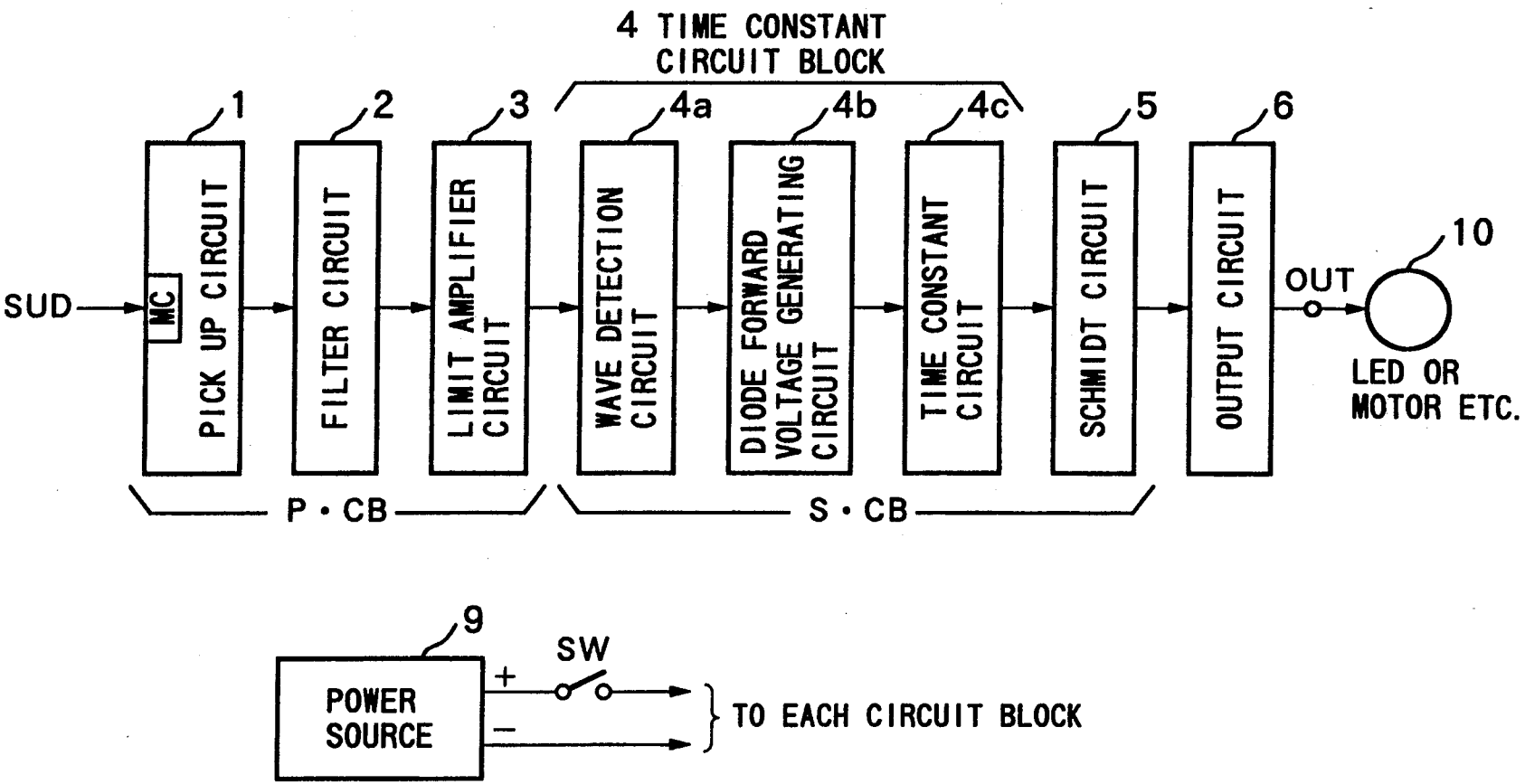
FIG. 1 is a functional block diagram which illustrates an example of a trigger circuit unit according to the present invention.
Figure 2:
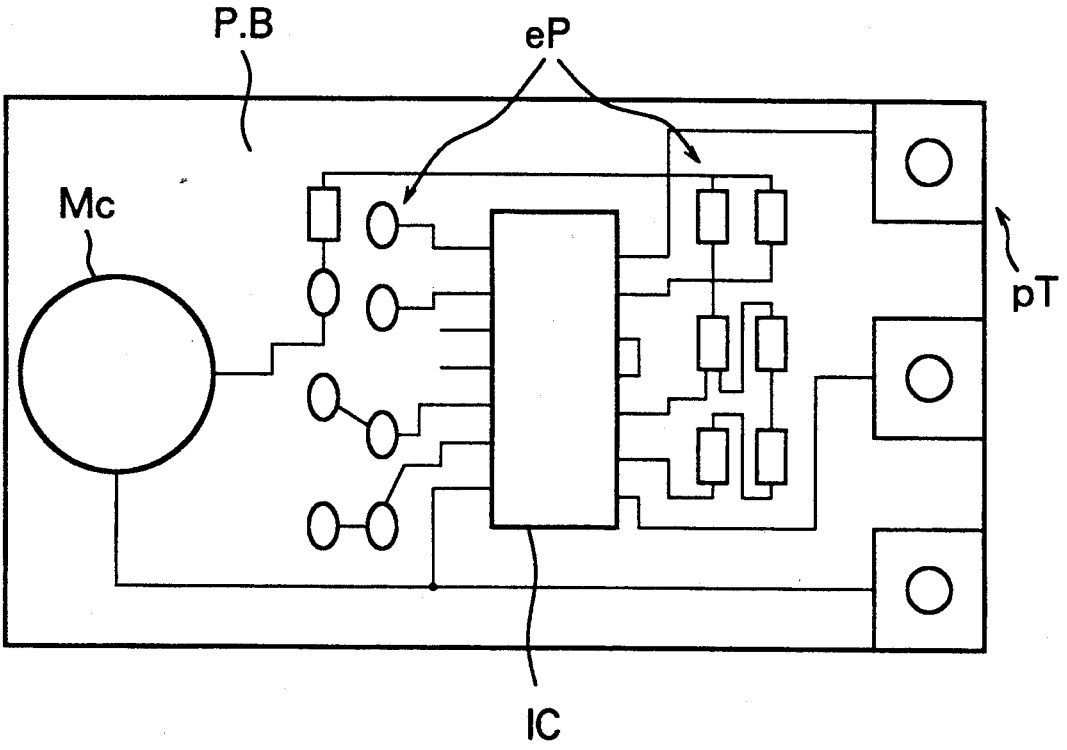
FIG. 2 is a plan view which illustrates an example in which the trigger circuit unit according to the present invention is formed on a circuit substrate.
Figure 3:
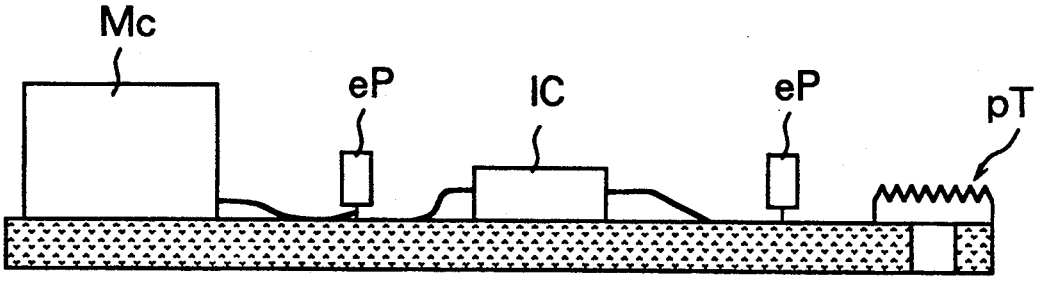
FIG. 3 is a front elevational cross sectional view which illustrates the circuit unit shown in FIG. 2.
Figure 4:
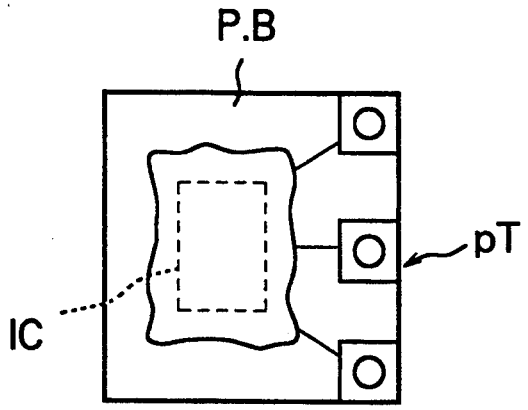
FIG. 4 is a plan view which illustrates another example in which the trigger circuit unit according to the present invention is formed on a circuit substrate.
Figure 5:
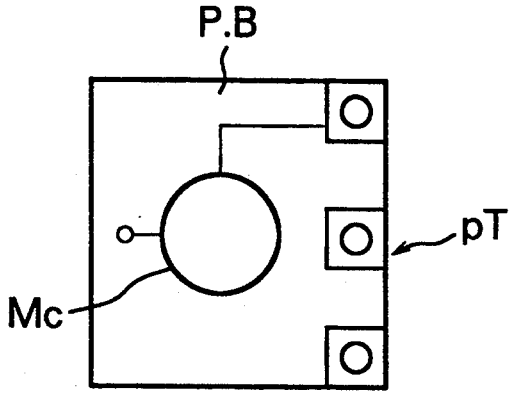
FIG. 5 is a backside view which illustrates the circuit unit shown in FIG. 4.
Figure 6:
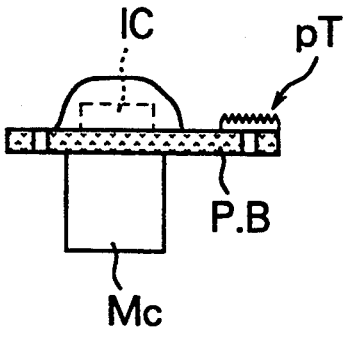
FIG. 6 is a front elevational cross sectional vie which illustrates the circuit unit shown in FIG. 4.
Figure 7:
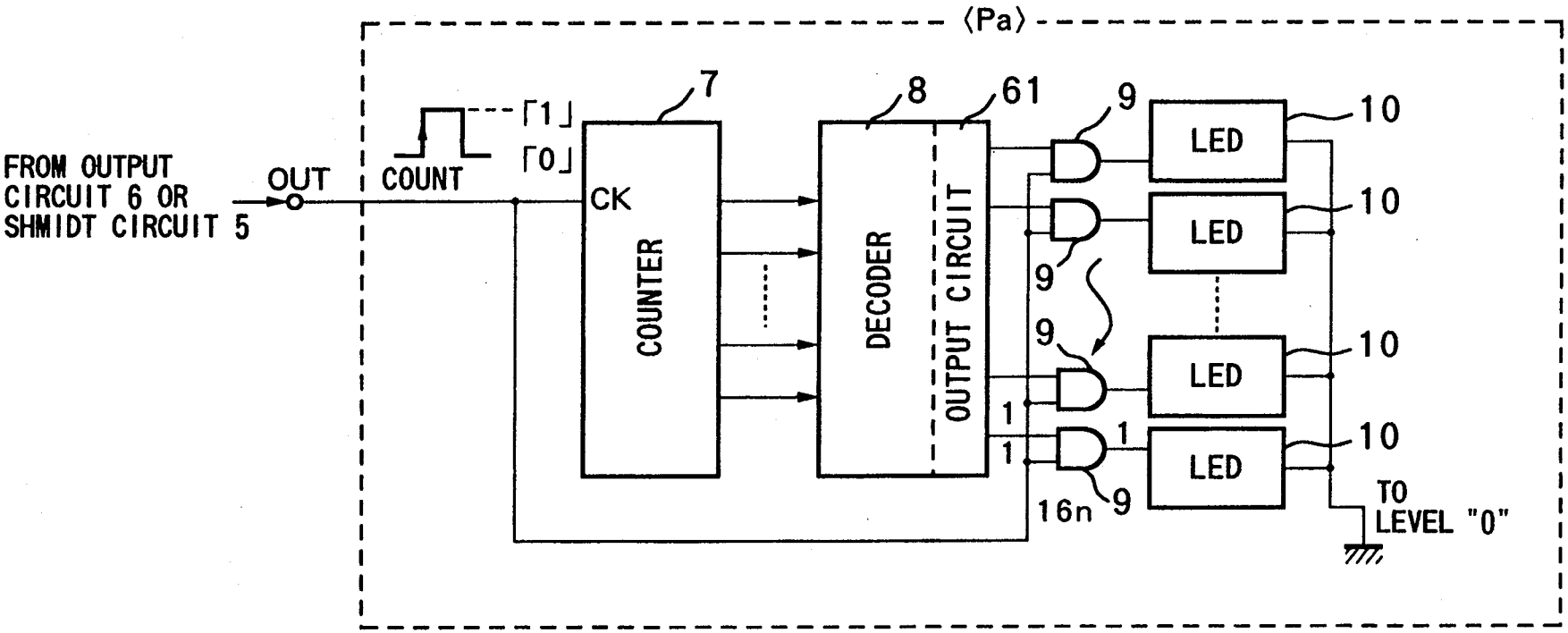
FIG. 7 is a functional block diagram which illustrates an example of a connection of the functional block shown in FIG. 1 connected to the basic trigger output and capable of regularly operating a plurality of members to be operated.
Figure 8:
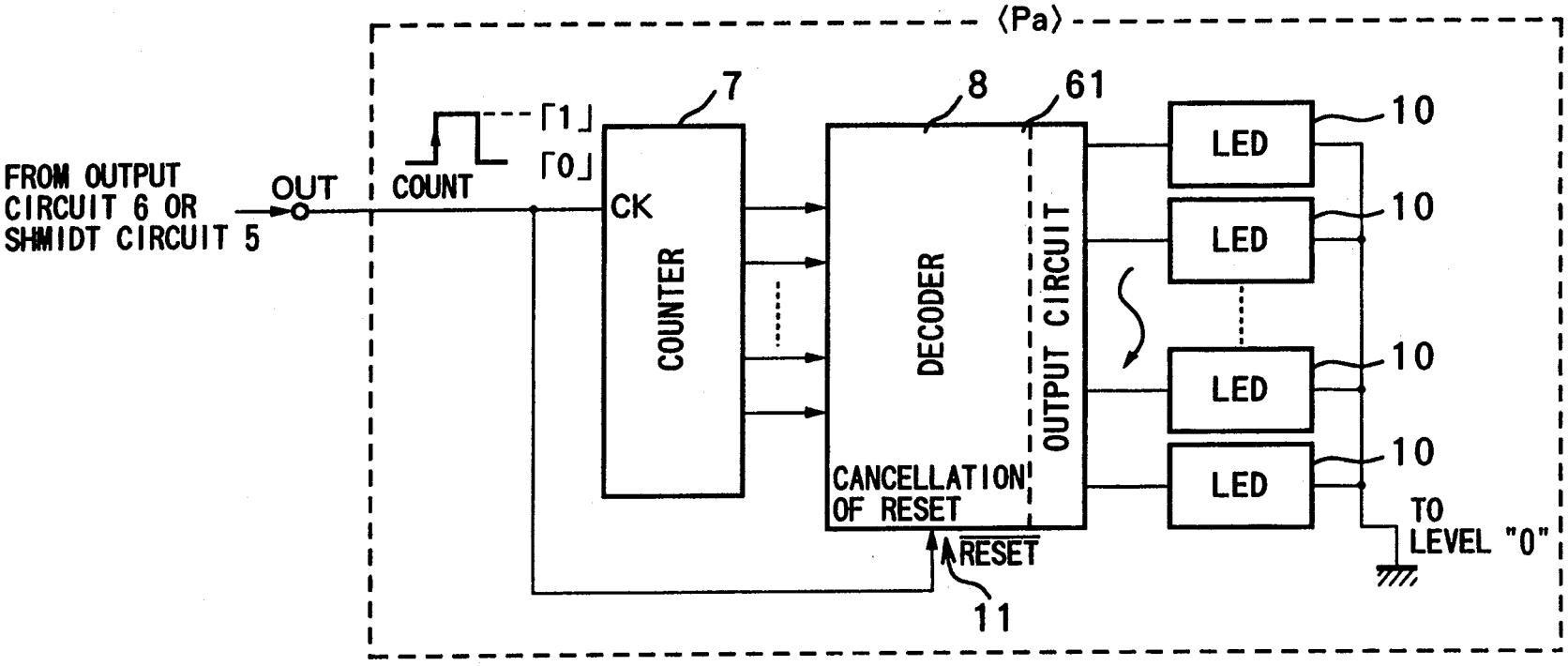
FIG. 8 is a functional block diagram which illustrates another example of a connection of the functional block shown in FIG. 1 connected to the basic trigger output and capable of regularly operating a plurality of members to be operated.
Figure 9:
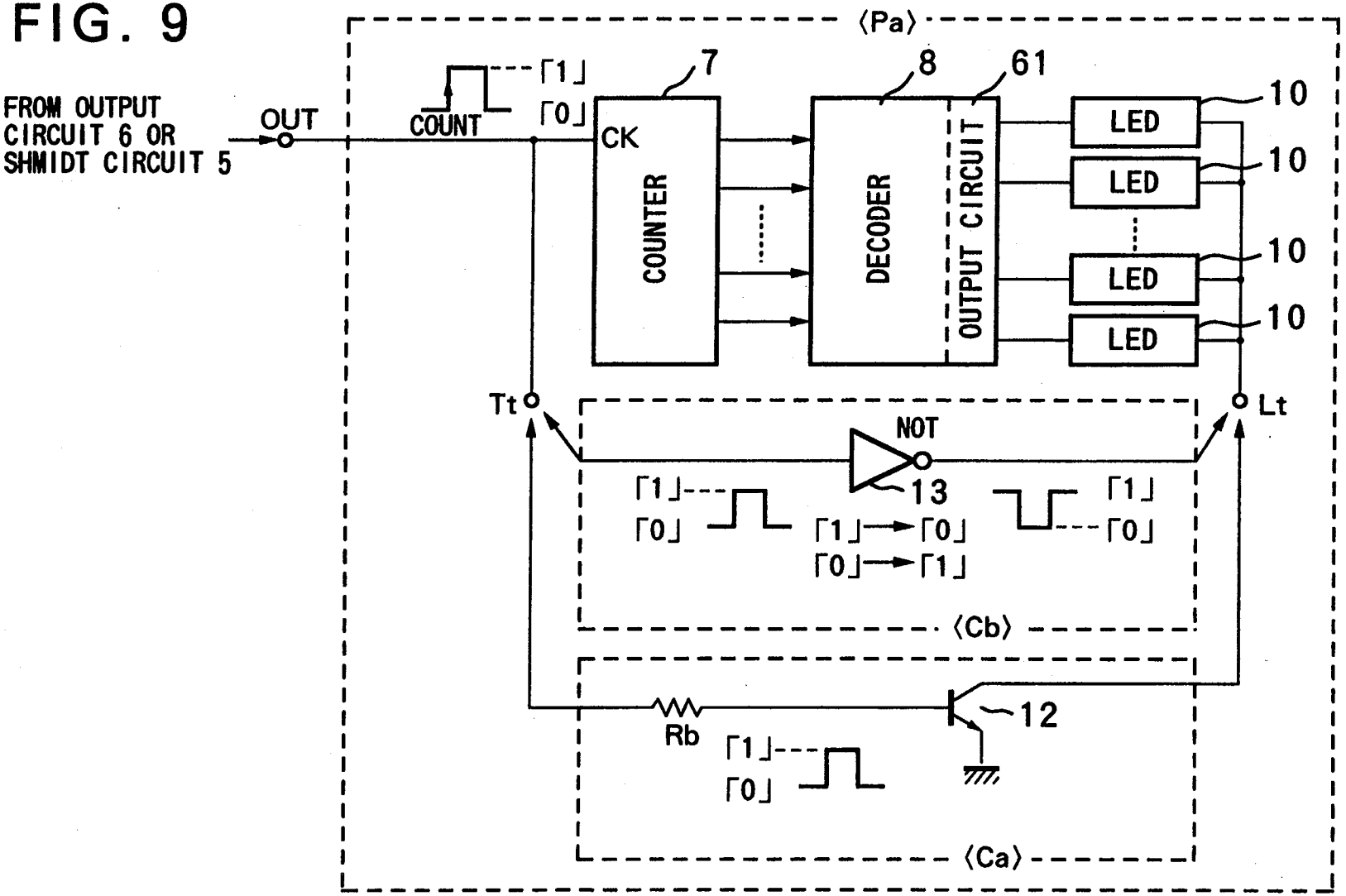
FIG. 9 is a functional block diagram which illustrates another example of a connection of the functional block shown in FIG. 1 connected to the basic trigger output and capable of regularly operating a plurality of members to be operated.
Figure 10:
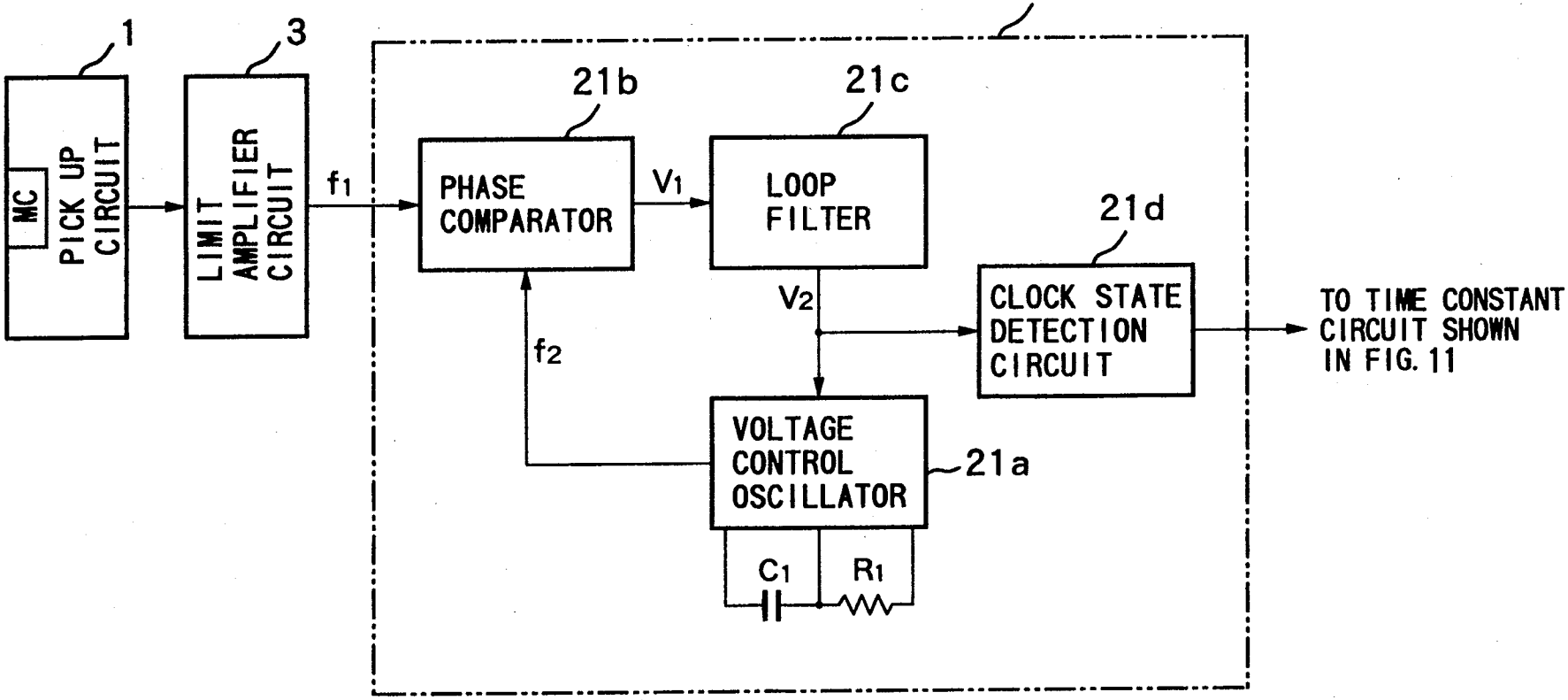
FIG. 10 is a functional block diagram which illustrates a PLL circuit.
Figure 11:
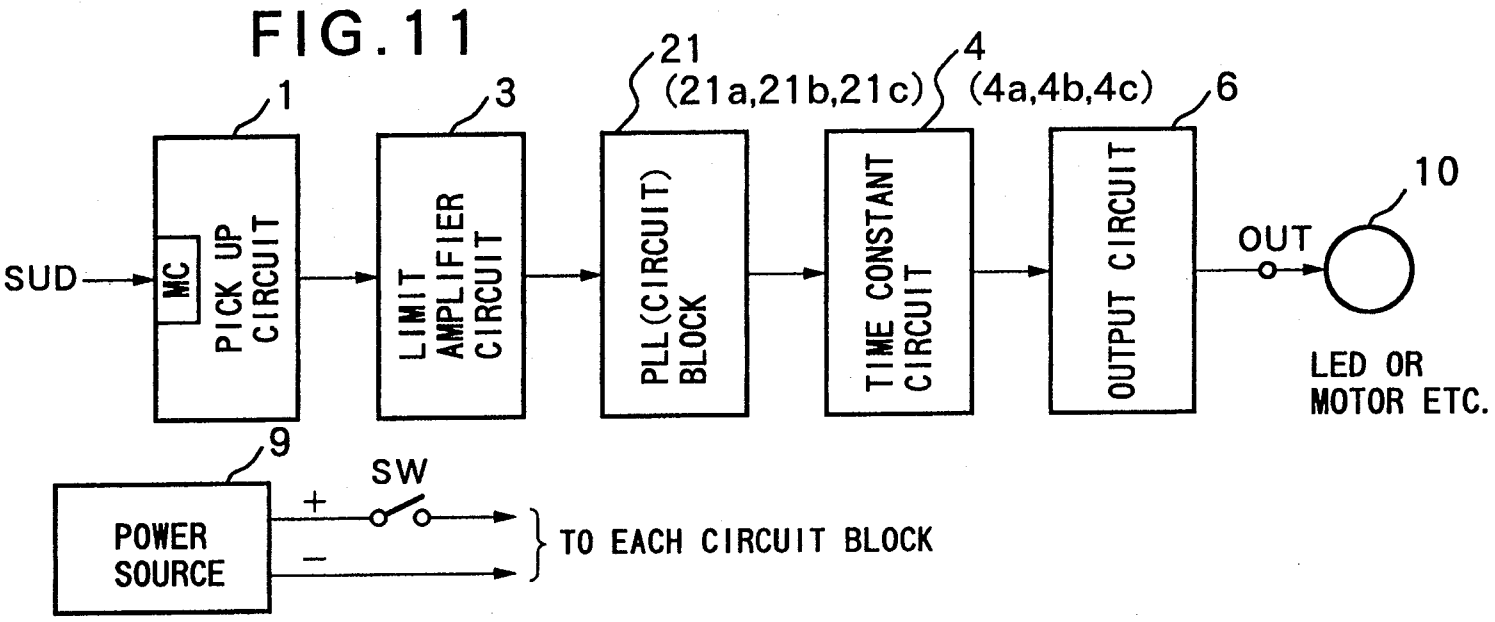
FIG. 11 is a functional block diagram which illustrates another example of a trigger circuit unit according to the present invention and so arranged that the filter of the functional block shown in FIG. 1 is omitted and the PLL functional block shown in FIG. 10 is inserted in place of the wave detecting circuit and the forward directional voltage generating circuit.
Figure 12:
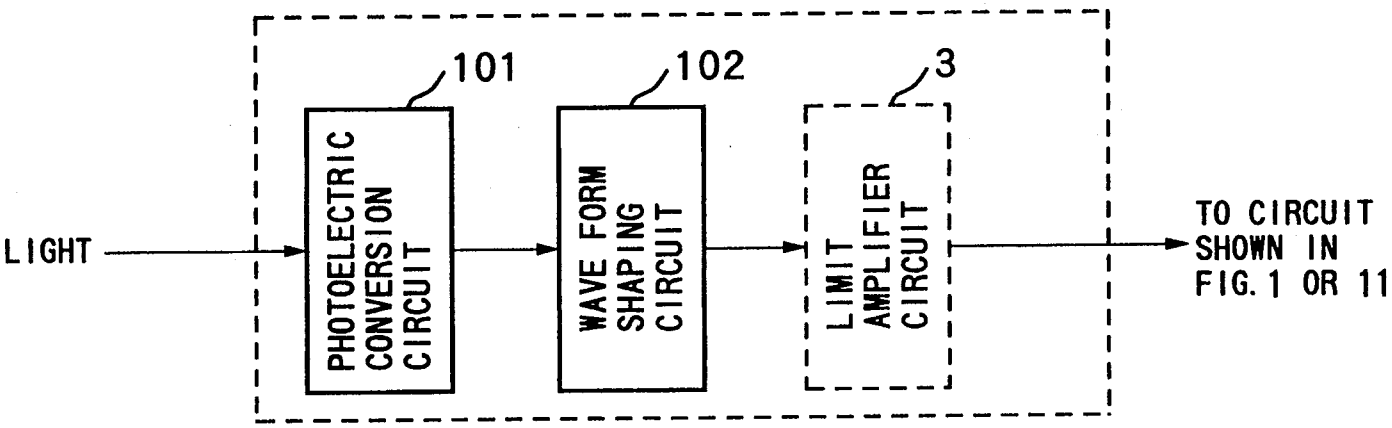
FIG. 12 is a functional block diagram which illustrates an example of a photoelectric conversion circuit additionally inserted into the forward circuit block in the functional block shown in FIG. 1.
Figure 13:
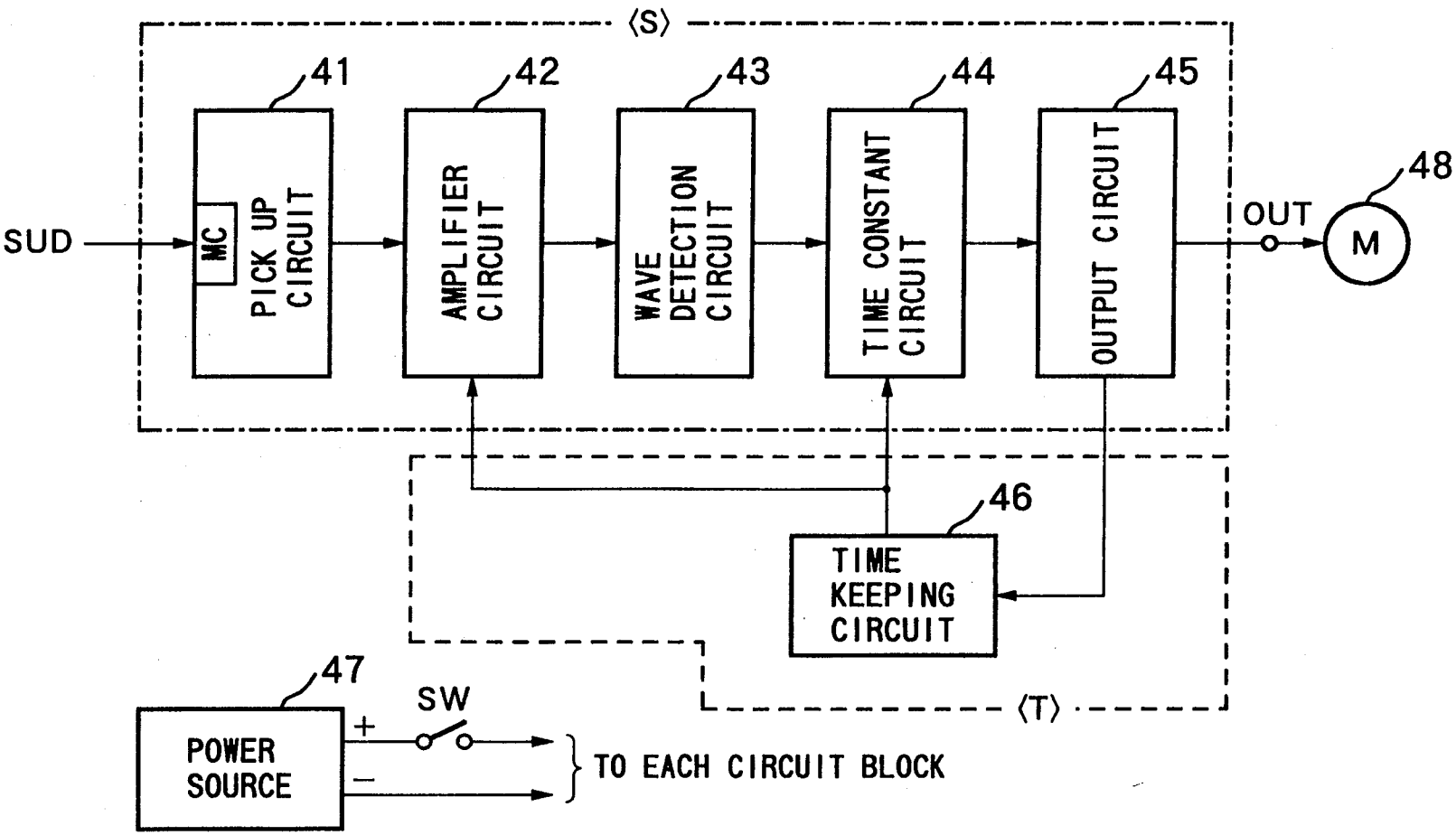
FIG. 13 is a functional block diagram which illustrates an example of a sound-response type conventional apparatus.
Figure 14A:
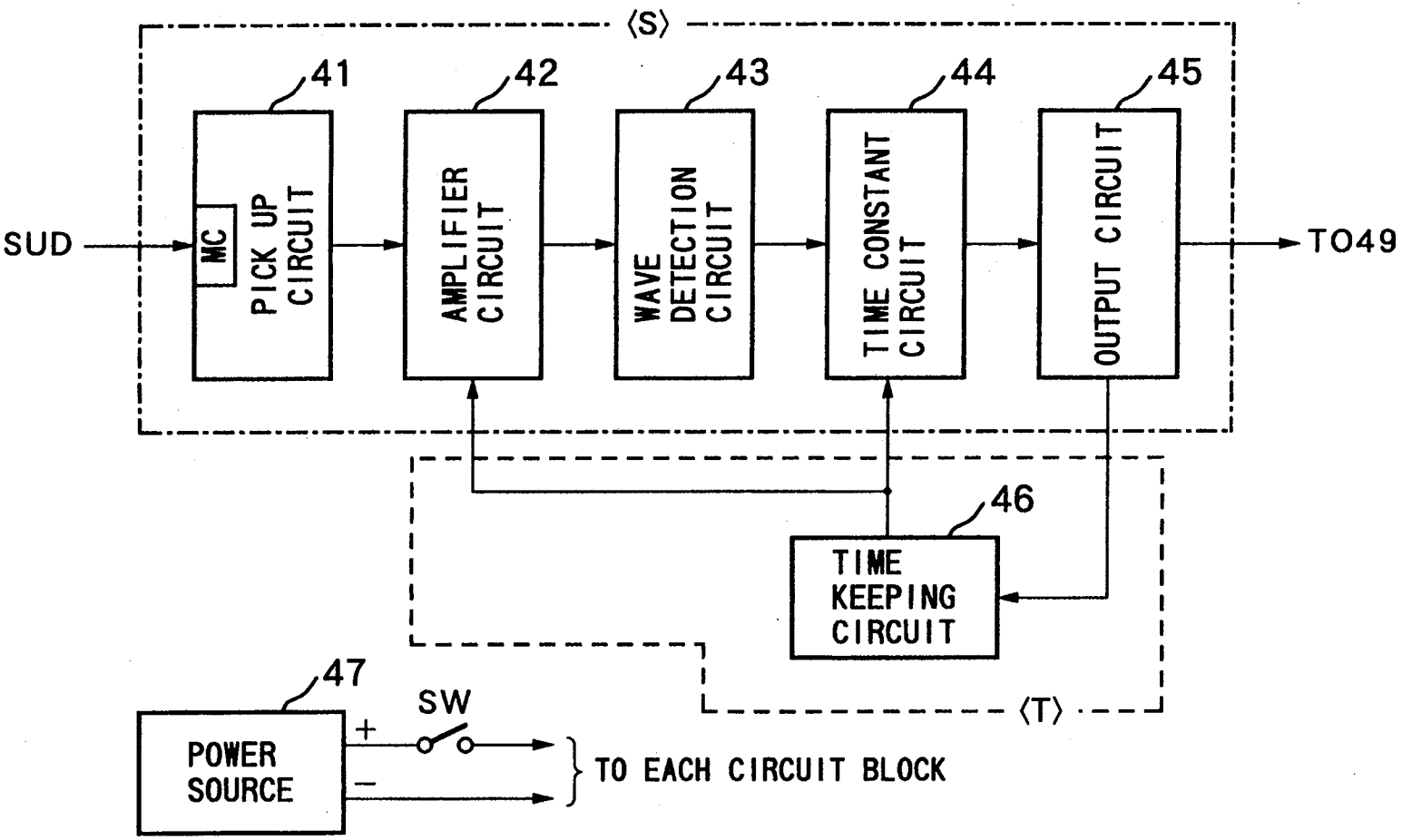
FIGS. 14A and 14B are a functional block diagram which illustrates another example of the conventional apparatus shown in FIG. 13.
Figure 14B:
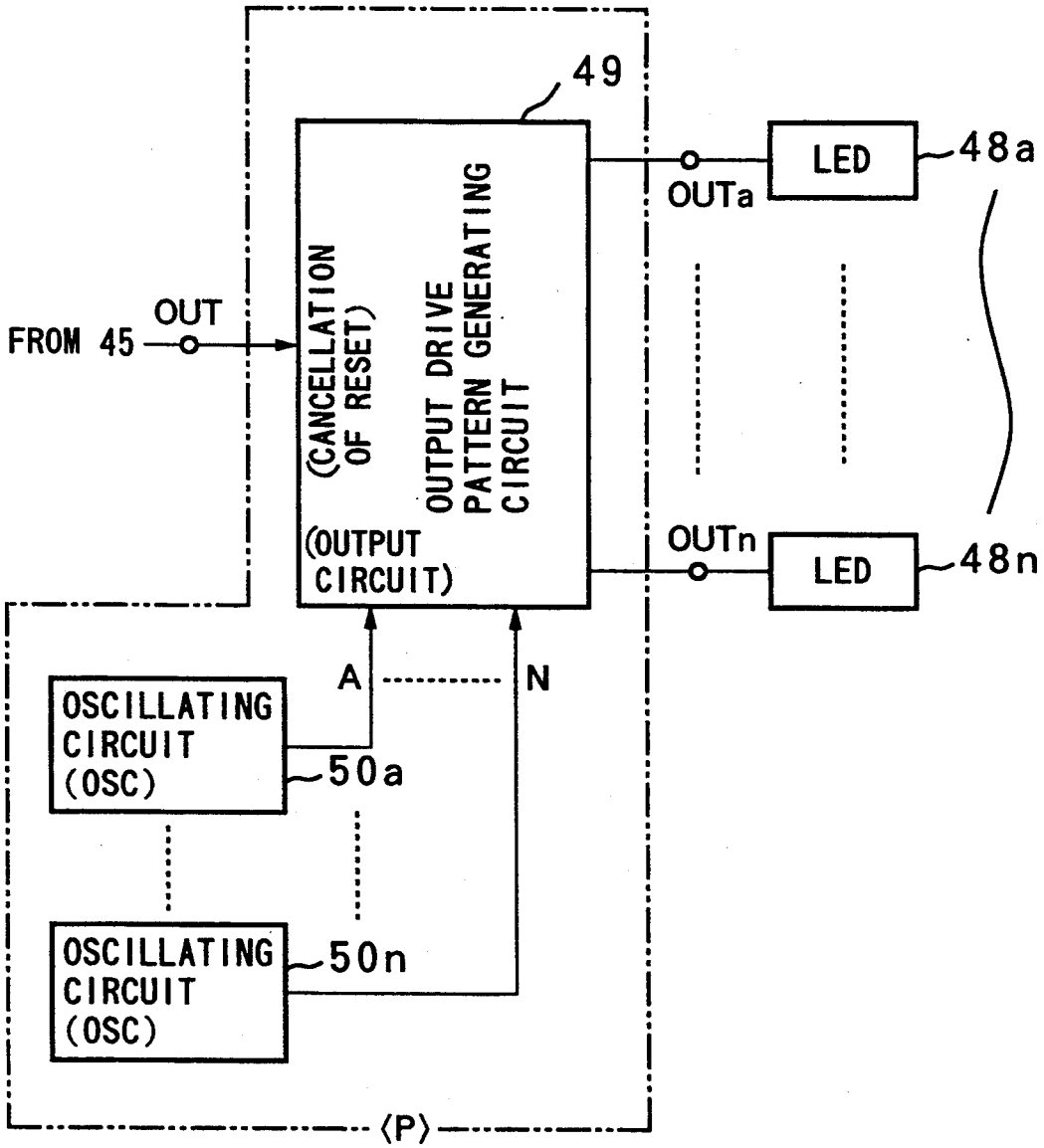
Figure 15A:
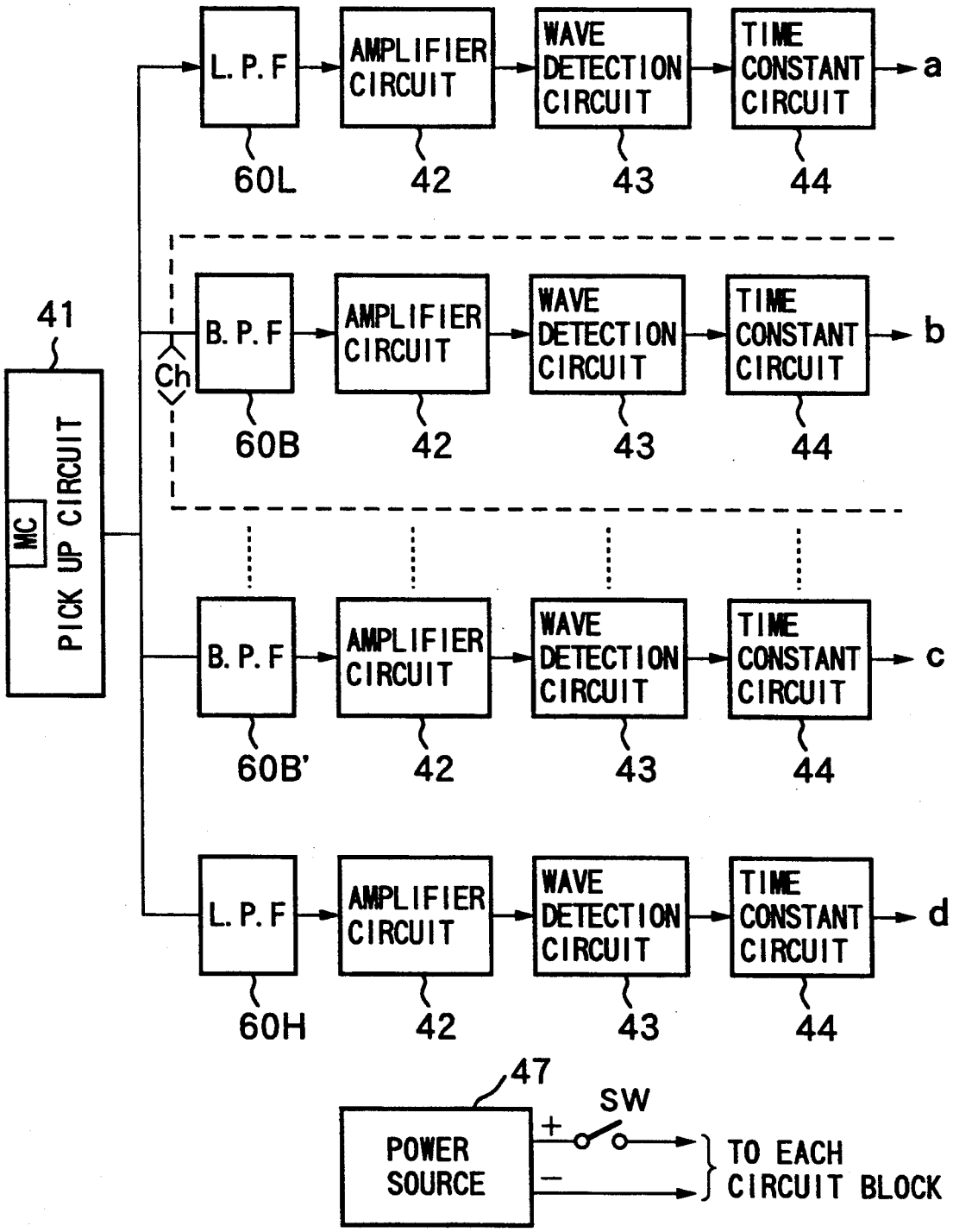
FIGS. 15A and 15B a functional block diagram which illustrates an example of a music synchronization type conventional apparatus.
Figure 15B:
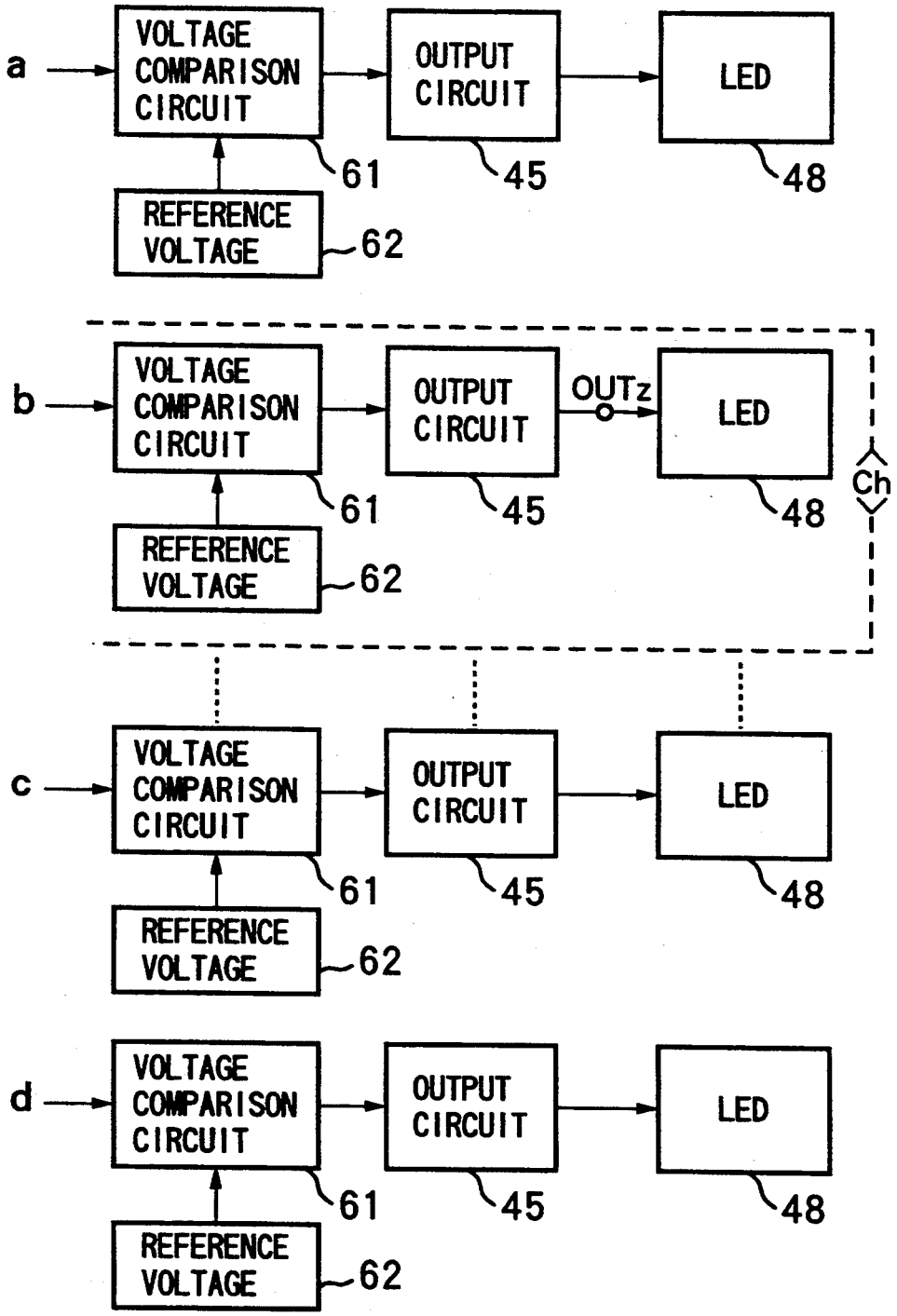

A preferred embodiment of the present invention will now be described. FIG. 1 is functional block diagram which illustrates an embodiment of a trigger circuit unit according to the present invention. FIG. 2 is a plan view which illustrates an example of a structure so arranged that the trigger circuit unit according to the present invention is formed on a circuit substrate. FIG. 3 is a front elevational cross sectional view which illustrates an example of the circuit unit shown in FIG. 2. FIG. 4 is a plan view which illustrates another example so arranged that the trigger circuit unit according to the present invention is formed on a circuit substrate. FIG. 5 is a backside view of the circuit unit shown in FIG. 4. FIG. 6 is front elevational cross sectional view which illustrates the circuit unit shown in FIG. 4. FIGS. 7 to 9 respectively are functional block diagrams which illustrate examples of connections established with the basic trigger output of the functional block shown in FIG. 1 so as to regularly operating a plurality of members to be operated. FIG. 10 is a functional block diagram which illustrates a PLL circuit. FIG. 11 is a functional block diagram which illustrates another example of the trigger circuit unit according to the present invention and arranged in such a manner that the filter of the functional block shown in FIG. 1 is omitted and the PLL functional block is inserted into the structure in place of the wave detecting circuit and a forward-directional voltage generating circuit. FIG. 12 is a functional block diagram which illustrates an example of a photoelectric conversion circuit to be inserted into a forward circuit block of the functional block shown in FIG. 1. Referring to FIGS. 1 to 11, symbol SW represents a power switch, reference numeral 9 represents a power supply such as a battery connected to each of the circuit blocks shown in FIGS. 1 and FIGS. 7 to 11 via the aforesaid switch SW so as to supply electric power to the circuit blocks.

In the circuit unit shown in FIG. 1 according to the present invention, reference numeral 1 represents a pickup circuit composed of a capacitor microphone or a piezoelectric device or the like. The pickup circuit 1 picks up signals of atmospheric sound of played music or the like so as to convert the signal into an electric signal of the sound of the music. Incidently, the present invention is not limited to the capacitor microphone. Furthermore, if the piezoelectric device is used in place of the microphone, the filter constant of a filter circuit 2 to be described later or the degree of the amplification of a limit amplifier circuit 3 must be changed in order to compensate the characteristics of the piezoelectric device which transmits a low level output in response to a low frequency sound of 1 KHz or lower and which efficiently responds to a high frequency sound.

Reference numeral 2 represents a filter circuit composed of a capacitor and a resistor selected so as to cut both of the high frequency component and the low frequency component of the signals of the sound of music picked up by the pickup circuit 1. That is, the filter circuit 2 is mainly composed of a capacitor and a resistor so selected to pass only the medium and low frequency band from about 100 to 800 Hz of a general audible frequency band ranged from about 20 to 20 KHz and to cut the frequency bands across the aforesaid band.

The reason why the filter circuit 2 is arranged to pass only the aforesaid band ranged from 100 to 800 Hz lies in that the tempo and the rhythm of the subject music is usually felt by the audience from a rhythm instrument such as a drum or vocal singing the melody and the rhythm instrument or the vocal is usually contained in a frequency band from about 100 to 800 Hz. It has been found a fact from experiments that the achievement of the object of the present invention to provide the trigger circuit unit for transmitting trigger signals for causing the light emitting members to be flashed in synchronization with music depends upon whether or not the operation such as flashing is performed in synchronization with the tempo created by a rhythm instrument or the downbeats of the vocal singing the melody of the music.

Reference numeral 3 represents a limit amplifier circuit for amplifying supplied signal from 100 to 800 Hz passed through the filter circuit 2 so as to transmit an output having a predetermined amplitude, the limit amplifier circuit 3 being composed of an inverter IC (which performs an inverter operation of a logic IC). The reason why the inverter IC is used in the amplifier circuit lies in that the inverter IC is employed as one of the most simple amplifying circuits because the amplifying circuit is simply required to amplify the signal, which has a predetermined range, and which has been transmitted from the filter circuit 2. The inverter IC is, for example, arranged to act as an analog amplifier by inserting relatively larger resistors as feedback resistors into the input and the output terminals of an NOT logic device. If a sufficient amplification ratio cannot be obtained due to the performance or the like of the element employed, a second NOT logic device is subsequently connected to the aforesaid amplifier in series while using no feedback resistor so as to make the overall body to be an analog amplifier, so that the proper amplification ratio is obtained. In order to relax the difference in the level of the output from the amplifier depending upon the level of the input signal of the sound of music, a device such as an FET capable of controlling a semiconductor resistor is disposed between the signal input terminal of the first NOT logic device and the 0-volt potential so as to realize an input level adjustment function. Furthermore, the output voltage from a time constant circuit block 4 to be described later is fed back as a signal whereby the aforesaid semiconductor resistor is controlled, so that a simple-type automatic level control (ALC) is performed. As a result, the level of the output from the amplifier is made to have a constant amplitude, or a low-voltage operational varistor or a diode limiter connected in series and formed by connecting different poles is used as a load to give a limit to the output from the amplifier. As a result, the level of the output from the amplifier is forcibly to have a predetermined amplitude or the like. Thus, even if the level of the input signal of the sound of music is not uniform, a constant level of the output from the amplifier can be maintained. According to this embodiment, a satisfactory output from the amplifier can be obtained by using only the first NOT logic device. Furthermore, the aforesaid diode limiter is connected to the NOT logic device so that the limit amplifier circuit is constituted by the aforesaid extremely simple structure. The output from the limit amplifier circuit is transmitted, for example, via a DC bias cutting capacitor. Incidently, the aforesaid logic IC comprises a low-energy-consumption type C-MOS type IC the output therefrom is reinforced. The reason for this lies in that, since the C-MOS type IC has an extremely high input impedance and therefore it can be considered that substantially no electric current is consumed at the input, only the input voltage must be paid attention. According to the present invention, the forward circuit block "P·CB" is formed by the pickup circuit 1, the filter circuit 2 and the limit amplifier circuit 3.

Reference numeral 4 represents a time constant circuit block comprising, according to this embodiment, a wave detecting circuit **4*a* composed of a diode, a forward-directional voltage generating circuit 4*b* and a time constant circuit 4*c* mainly composed of a resistor and a capacitor. The wave detecting circuit 4*a* has a diode for extracting only a positive voltage portion of the electrical signal supplied from the amplifier circuit 3, so that the wave detecting circuit 4*a* transmits a rectified wave, the half wave of which has been rectified. The forward-directional voltage generating circuit 4*b* is so constituted that two or three diodes are connected in series so as to set the output voltage of a positive (or negative) voltage portion of the analog output wave, which has been transmitted from the amplifier circuit 3 and then rectified and transmitted from the wave detecting circuit 4*a*, to be a predetermined voltage level. That is, the aforesaid wave detecting circuit 4*a* and the forward-directional voltage generating circuit 4*b* perform an important roll to detect only signals, the voltage levels of which are higher than a certain voltage level, among the analog signals transmitted from the logic IC of the amplifier circuit 3. In a case where a low level voltage of 2 to 2 V is supplied to the overall circuit, only forward directional voltage inevitably generated when the electric signal passes through the wave detecting circuit 4*a* comprising the diode may be the desired voltage level by adjusting the degree of hysteresis of a Schmidt circuit 5 to be described later. That is, in a case where voltage of a low level is supplied to the overall circuit, the forward-directional voltage generating circuit 4*b* can be omitted from the structure by making the function of the forward-directional voltage generating circuit 4*b* to be performed by the wave detecting circuit 4*a***.

If the electric signal which has passed through the forward-directional voltage generating circuit **4*b* is as it is transmitted, an excessively steep rise or rapid down takes place. Therefore, the time constant circuit 4*c* adjust the time in which the supplied electric signal is charged/discharged by means of the resistor and the capacitor thereof so as to properly integrate the electric signal while maintaining the timing of the sound of the medium and low frequency of about 100 to 800 Hz. That is, the signals of the drums or the vocal expressing the rhythm or the downbeats of the music are extracted from the signals of the sound of music supplied to the pickup circuit 1**, the signals being extracted while being formed into analog pulse signal output. The term "analog pule signal output" used hereinbefore is meant a signal in the form of an analog signal including a pulse-like rising portion. According to the present invention, the integration time properly matching to maintain the aforesaid sound timing is set to a range from about 50 ms to 200 ms found from basic experiments, resulting in a satisfactory effect to be obtained.

Reference numeral 5 represents the Shmidt circuit comprising the inverter operation logic IC causes the analog pulse signal supplied from the time constant circuit 4c to perform a Shmidt operation while using the threshold voltage arbitrarily determined by a resistance value as a reference. As a result, the waveform of the aforesaid analog pulse signal is shaped to become a stable digital waveform signal even if the analog pulse signal involves a slight voltage undulations. The inverter operation logic IC for use in the arrangement according to this embodiment is the same as the IC which constitutes the limit amplifier circuit 3 but it is used to perform another roll. An exclusive IC for the Shmidt operation may be used in place of the inverter operation logic, resulting in the similar effect to be obtained. Therefore, a pulse-like rising portion showing the signal of the drums or the vocal contained by the analog signal transmitted from the time constant circuit 4c is extracted as a digital signal output which rises in the form of a rectangular shape. According to the present invention, the aforesaid digital signal which is the output from the Schmidt circuit 5 is the basic trigger output from the circuit block according to the present invention. Since a small basic trigger output of about 5 mA is made when a low voltage level of about 3 V is supplied to the inverter IC, it is able to at most operate one or two other logic ICs or LEDs and, in principle, it is too weak to directly rotate a motor or the like. Incidentally, the time constant circuit block 4 and the Schmidt circuit 5 constitute a waveform converting circuit block S·CB.

According to the present invention, the basic trigger output obtainable from the Schmidt circuit 5 is electrically amplified by the output circuit 6 so as to supply it to the outside through an externally outputting connection portion connected to the output point OUT. As an alternative to this, the output circuit 6 is formed into a logic circuit having a counting function and a decoding function. On the basis of the output from this logic circuit, the devices such as the LEDs or the motor to be operated are operated in synchronization with the music. Then, the aforesaid operation will now be described.

The trigger circuit unit (the pickup circuit 1 to the Schmidt circuit 5) whereby the basic trigger output is obtained can be formed into an extremely small mounted body of trigger circuit unit by integrally mounting the elements including the output circuit 6 and the like on one printed circuit board P·B, for example, as shown in FIGS. 2 to 6. That is, as shown in FIGS. 2 and 3, the printed circuit board P·B is composed of a trigger circuit portion formed by integrally mounting the small capacitor microphone Mc of the pickup circuit 1, the limit amplifier circuit 3, the inverter IC forming the Schmidt circuit 5, small elements such as the diode, the resistor, the capacitor which constitute the time constant circuit block 4 connected to the aforesaid IC, and required elements eP such as various chip elements, printed elements (printed resistor) on the upper surface of a substrate having a size of about 10 mm×10 mm and a printed circuit connection portion pT serving as an externally connecting terminal connected to the output terminal of the trigger circuit on the board. As a result, the thickness can be reduced to about 5 mm. The elements eP may be mounted on either side or both sides of the board P·B.

FIGS. 4 to 6 respectively are a plan view, a backside view and a front elevational cross sectional view which illustrates an example of the trigger circuit unit according to the present invention and arranged in such a manner that the inverter IC and the elements eP are integrally formed into an IC by the chip-on board manufacturing method, the aforesaid IC is directly secured to the printed circuit board P·B by using an epoxy resin or the like, and the secured IC is connected to the individually mounted capacitor microphone Mc and the printed circuit connecting portion pT and the like. As described above, the trigger circuit unit according to the present invention and arranged to form a trigger signal whereby the light emitting member or the like is operated in synchronization with music is constituted by using the inverter IC in order to decrease the number of the required elements. Therefore, the apparatus according to the present invention can be formed into an extremely small size and volume (about 1 $cm^3$) product as compared with the conventional apparatus in a case where it is intended to be mounted on a toy. In a case where the apparatus according to the present invention is adapted to a structure to turn on one or two LEDs in synchronization with the timing of the sound of music, the output circuit 6 can be omitted because the aforesaid operation of turning on the LEDs can be performed with the output from the Schmidt circuit 5, that is, the basic trigger output. As a result, an apparatus composed of only one printed circuit board P·B and arranged to turn on the LEDs can be realized while reducing the overall size to be the aforesaid volume (about 1 $cm^3$) by mounting the LEDs on the printed circuit board P·B and by supplying electric power to the connection portion pT of the printed circuit board P·B.

The aforesaid trigger circuit unit according to the present invention is so arranged that the signals contained in the sound of music picked up the pickup circuit 1 and having a predetermined range (signals of 100 to 800 Hz which contains the major portion of signals of the rhythm instrument such as a drum or vocal) are transmitted to the output portion thereof in an enumerated manner, that is, the signals are simply in series transmitted while allowing to coincide with the timing of the sound. Therefore, although the arrangement for simply amplifying the aforesaid signal is effective when it is adapted to a personal ornament or a portion of toys, the obtainable effect is sometimes unsatisfactory because a relatively simple operation can be at most realized when it is used as the trigger signal to operate a plurality of light emitting members or motors. Accordingly, an embodiment of the present invention is arranged in such a manner that a logic circuit (such as a counter IC) having a counting function or a decoding function is connected to the output portion of the aforesaid trigger circuit so as to extract the output from the trigger circuit unit in accordance with a plurality of output patterns which coincide with the timing of the sound of music. Then, this embodiment will now be described with reference to FIGS. 7 to 9.

FIG. 7 is a functional block diagram which illustrates an example of a connection established between the Shmidt circuit 5 and the devices to be operated with the output from it through the trigger circuit unit according to the present invention and comprising a, for example, 4-bit or another number of bits binary counter IC7 connected to the output portion of the Schmidt circuit 5 shown in FIG. 5, a decoder IC8 which receives the output from the counter IC7, an output circuit 61 composed of an electric-power amplifying device or the like inwardly as illustrated or externally connected to the output portion of the decoder IC8, AND gate devices 9 for obtaining the logical product of the input of the counter IC7 and the output from the decoder IC8, and light emitting members 10 such as LEDs. As an alternative to the decoder IC8 shown in FIG. 7, a read only memory (ROM) may be used and the output obtained in accordance with memorized data is treated as the decoded output value, resulting in a similar effect to be obtained to that obtainable from the decoder IC8. Therefore, in the description to be made hereinafter, elements capable of performing the decoding operation are collectively called the decoder IC8.

In a case where the aforesaid counter IC7 is, for example, a 4-bit binary counter, when the outputs from the trigger circuit unit according to the present invention are in series and sequentially supplied to the aforesaid counter IC7, binary and four-digit output signals (trigger signals) corresponding to the number of input rectangular pulses obtained from the basic trigger output are sequentially, that is, regularly formed at each of four output terminals of the counter IC7. Since the pattern of the output signals formed at each output terminal of the counter IC7 is changed in synchronization with the basic trigger output from the trigger circuit unit, each output signal (each trigger signal) from the counter IC7 is electrically amplified to supply it to each of a plurality of the light emitting members such as LEDs or a plurality of motors. As a result, the aforesaid light emitting members or the motors can be operated while being changed regularly and periodically in synchronization with the aforesaid basic trigger output.

According to the embodiment of the present invention shown in FIG. 7, the output from the counter IC7 is supplied to the decoder IC8 and the outputs from the decoder IC8 are made to be sequentially changed in synchronization with the basic trigger output signal from the trigger circuit. Because of the characteristics of the counter IC7 or the decoder IC8, if the aforesaid trigger input is eliminated during the operation of the counter IC7 or the decoder IC8, the output terminal of it is brought to a holding state with the logical level (the output value) transmitted at that time. As a result, the operation of the motors or the light emitting devices is not stopped, causing electric power to be consumed wastefully.

Accordingly, the embodiment shown in FIG. 7 is arranged in such a manner that the logical product of the input of the counter IC7 and each output of the decoder IC8 is obtained so as to stop the supply of the output to the members to be operated, that is, to the light emitting members 10 if no basic trigger input is supplied to the counter IC7 though an output is made from the decoder IC8. The AND gate devices 9 are provided to realize the aforesaid state. The fact that the logical product of the input of the counter IC7 and each of the output terminals of the decoder IC8 (or each of the output terminals of the counter IC7) is obtained means that, if the basic trigger is supplied to the counter IC7 and no output appears at the output terminal of the decoder IC8 during the aforesaid input, the operating (turning on) trigger signal for turning on the light emitting members is not transmitted. The operating trigger is transmitted only when both the input and the output are simultaneously made. Therefore, the aforesaid structure is preferably employed to save energy.

FIG. 8 illustrates an example so arranged that the decoder IC8 shown in FIG. 7 has a resetting portion 11 so as to detect a state where no basic trigger output signal is supplied to the counter IC7 and a signal denoting the aforesaid state is used as a reset signal for resetting the output from the decoder IC8. Furthermore, a fact that the basic trigger output signal has been supplied is detected and a signal denoting aforesaid fact is used as a reset cancelling signal which is then supplied to the resetting portion 11 of the decoder IC8. As a result, if the basic trigger output signal disappears due to, for example, a stop of the music, resetting to a logical level (output value) whereby the output from the decoder IC8 is invalidated is immediately made so that the operation of the members to be operated is inhibited. At this time, the state of the counter IC7 is brought to a holding state in which each binary output value transmitted at the moment the basic trigger output signal has disappeared is held. When the basic trigger output signal is again supplied, the count value of each of the aforesaid binary output values is increased and resetting of the decoder IC8 is cancelled at this time because the basic trigger output signal is supplied. Therefore, the decoder IC8 immediately transmits a value decoded in accordance with each of the binary output values from the counter IC7, so that the members to be operated are operated. As a result of the operation thus performed, the wasteful electric power consumption can be prevented.

FIG. 9 illustrates another example of the structure arranged for the purpose of preventing the wasteful electric power consumption. Referring to FIG. 9, symbol Lt represents a common connection point for the light emitting members 10 adjacent to the ground, Tt represents a connection point which is connected to the input terminal of the counter IC7 and from which the basic trigger output can be taken out. The aforesaid connection points are used for the purpose of making the description easier. Regions surrounded by alternate long and short dash lines Ca and Cb are flashing control blocks for controlling the flashing operation of the light emitting members. Either of the two flashing control blocks is used in an actual circuit structure. In the block surrounded by the alternate long and short dash line Ca, reference numeral 12 represents a switch device comprising, for example, a transistor or an FET and Rb represents a base current limit resistor. In the block surrounded by the alternate long and short dash line Cb, reference numeral 13 represents an inversion circuit comprising, for example, an inverter operation logic IC. Referring to FIG. 9, the same reference numerals as those shown in FIGS. 7 and 8 represent the same functional circuit blocks. In the example shown in FIG. 9, if the block surrounded by the alternate long and short dash line Ca is connected between the common connection point Lt and the connection point Pt, the transistor of the switching device 12 is turned on due to the appearance of the basic trigger output at the connection point Tt. As a result, the common connection point Lt is grounded, so that any one of the light emitting members 10 is operated (emits light) in accordance with the output value from the decoder IC8. The basic trigger output is not present is eradicated, the aforesaid transistor is turned off and the common connection point Lt is not grounded. As a result, all of the light emitting members 10 are forcibly brought to a non-operation (turned off) state regardless of the output value from the decoder IC8. As a result, the wasteful electric power consumption can be prevented. In a case where the block surrounded by the alternate long and short dash line Cb is connected to the structure shown in FIG. 9, the basic trigger output appears at the connection point Tt, causing the logical level at the connection point Tt is inverted. As a result, a state same as the grounded state is realized, so that the light emitting member 10 is operated (emits light). If the basic trigger output is eradicated, a low level (substantially equal to 0 V of the grounding potential) substantially appears at the connection point Tt. Therefore, although the eradication of the counting operation performed by the counter IC7 is made, the inverting circuit 13 undesirably inverts the low level allowed to appear at the connection point Tt and therefore undesirably transmits the high level voltage to the common connection point Lt. Since the ground side of the light emitting member 10 is not non-grounded (open state) in contrast to the aforesaid switching device 12, an inverse directional voltage is undesirably applied to the light emitting members 10 connected to the outputs of the decoder IC8 if a low level output is included in the outputs of the decoder IC8 although the basic trigger output has been eradicated. As a result, if the light emitting members 10 are small electric lamps, some of them are undesirably turned on. In this case, one diode is inserted subsequently to the inverting circuit 13 so as to allow only the low level to be transmitted to the common connection point Lt. As an alternative to this, an output circuit 61 of a type which transmits an open output if the decoder IC8 is non-active is used so as to overcome the aforesaid problem. In a case where the light emitting members 10 are limited to the LEDs, they do not emit light even if the inverse directional voltage is applied thereto because the LEDs are (light emitting) diodes. Therefore, the necessity of the aforesaid arrangement can be eliminated. Therefore, also according to the structure shown in FIG. 9, the wasteful electric power consumption can be prevented similarly to the structures respectively shown in FIGS. 7 and 8.

The outputs (trigger outputs) from the standard counter IC7 and the decoder IC8 are varied from a weak output to a relatively high level output depending upon the difference in the type or the structural classification. In a case where the light emitting member 10 which is the member to be operated is an electric lamp which requires certain electric power or in a case where the light emitting member 10 is simultaneously operated together with a motor or the like, the member to be operated cannot be sometimes directly operated with the aforesaid trigger output. In the aforesaid cases, the electric power amplifying device is added to each output terminal of the decoder IC8. In a case where a motor or a light emitting member which includes the operating electric power amplifying device is used, it can be directly operated with the aforesaid trigger output.

If an LED or a small electric lamp which requires small electric power is employed as the light emitting member, it is able to emit light with the signal of the trigger level output from the counter IC7 or the decoder IC8. Therefore, in a case where a light emitting member which consumes small electric power is used, the aforesaid LED or the small electric lamp is fastened to the upper surface of the printed circuit board P·B on which the trigger circuit unit is mounted and a small battery such as a small button battery or a lithium battery is mounted together with a switch. Thus, the structure starting from the power supply to the light emitting body can be formed into one unit according to the present invention. As a result, the trigger circuit unit according to the present invention can be formed into a personal ornament such as an accessary exemplified by a brooch or a badge.

The above-mentioned embodiments of the present invention is so arranged that the band from about 100 to 800 Hz which includes the major portion of a voice signal of a rhythm instrument which characterizes the music or vocal singing the melody is taken among the audible frequency component included by the music by the filter circuit 2. Furthermore, the trigger signal for causing the light emitting member to perform an operation in synchronization with the change in the frequency signal. However, the aforesaid constant band sound may be taken by a PLL block 21 shown in FIG. 10 employed in place of the filter circuit 2.

In the PLL block 21 shown in FIG. 10, the oscillation frequency of a voltage control oscillator (VCO) 21*a* is arbitrarily selected from 100 to 800 Hz so as to be set. Furthermore, a relatively the capture range is set. The aforesaid setting operation is performed by adjusting the level of control voltage V2 of the VCO 21*a*, or by adjusting the oscillation characteristics of the VCO 21*a*, or by changing the constant of a loop filter 21*c*. A phase comparator 21*b* subjects frequency f1 of a music signal supplied from the limit amplifier 3 and frequency f2 of the VCO 21*a* to a comparison. Output voltage V1 denoting the result of the comparison is integrated by the loop filter 21*c*, so that voltage V2 is generated and it is then fed back as the control voltage V2 to the VCO 21*a*.

The oscillation frequency of the aforesaid PLL circuit block 21 is controlled with the control voltage V2 for controlling the VCO 21*a* so as to make the VCO 21*a* follows the frequency f1 of the music signal supplied to the phase comparator 21*b* in a locked state. If f1 is deviated from the lock range, V2 is not generated and therefore the above-described following operation is not performed. Therefore, a discrimination whether or not the subject state is the locked state can be made by detecting whether or not V2 is present. Reference numeral 21*d* represents a locked state detecting circuit for use to make the discrimination.

Therefore, by connecting the output terminal of the locked state detecting circuit 21*d* in the PLL circuit block 21 to the time constant circuit 4*c*, a trigger circuit unit capable of performing the operation similarly to the trigger circuit unit according to the present invention can be constituted. FIG. 11 is a functional block diagram which illustrates an example of a circuit unit which utilize the PLL block 21 according to the present invention. According to this embodiment, a PLL block having the VCO 21*a* the oscillation frequency substantially set to a range from 200 to 400 Hz and arranged to widen the capture range as much as possible is used, resulting in a satisfactory effect obtainable from the basic trigger output according to the embodiment shown in FIG. 1 to be obtained. Furthermore, since the PLL block 21 formed into an IC is used, the number of the required elements is substantially the same as that according to the structure shown in FIG. 1. Therefore, a satisfactory effect can be obtained from the circuit according to the embodiment shown in FIG. 11 for obtaining the basic trigger output.

FIG. 12 is a functional block diagram which illustrates a light detecting portion for picking up surrounding flash light to cause the light emitting member to emit light in synchronization with the flashing of the surrounding light in addition to the aforesaid flashing operation of the light emitting member to be performed in synchronization with the music. Referring to FIG. 12, reference numeral 101 represents a photoelectric conversion circuit comprising Cds or the like, and 102 represents a wave shaping circuit for shaping the output waveform from the photoelectric conversion circuit 101. As a result of the action of the circuit 102, the electric signal obtained at the photoelectric conversion circuit 101 is shaped into a predetermined waveform. The shaped signal is supplied to the limit amplifier 3 shown in FIG. 1 so as to be treated similarly to the constant band music signal supplied from the filter circuit 2. As a result, an operating trigger signal for actuating the light emitting member is formed.

Since the present invention is arranged as described above, the light emitting member or the like is operated in synchronization with music, only the sound ranged from 100 to 800 Hz is detected from the music, and the detected signal of the predetermined frequency is converted into a rectangular pulse signal by the forward circuit block which is composed of the inverter operation IC and required small electric elements such as capacitor and a resistor and which can therefore be formed into a small printed circuit unit and a waveform conversion block. The rectangular pulse signal is, as the operating trigger signal, transmitted through the external output terminal of the circuit unit. Therefore, trigger circuit unit according to the present invention can be extremely preferably adapted to the light emitting member such as the LED or the motor for use in a personal ornament or a toy so a to be operated in synchronization with music.

Since the trigger circuit unit according to the present invention has the output terminal to which the logic circuit having the counting function or the decoding function so as to use the basic trigger output from the circuit unit to cause a plurality of the members to be operated such as the light emitting members or the motors to be sequentially or periodically operated in accordance with a pattern which synchronizes with music. Therefore, satisfactory operation state can be realized.

Furthermore, since the trigger circuit unit according to the present invention is so arranged that the logical product of the basic trigger output and the output from the logic circuit is calculated. Therefore, if there is no basic trigger output, the conditions to operate the members to be operated cannot be met. Therefore, an operation state in which the wasteful electric consumption can be prevented and which coincides with the music can be realized.

Furthermore, since the size of the trigger circuit unit according to the present invention can be satisfactorily is the logic IC or the like is used, a personal ornament which can be formed into an accessary such as brooch and which has a light emitting member which flashes in synchronization with music can be constituted by using a small battery which can be mounted on the circuit board as a power supply and very small LED as the light emitting member mounted on the circuit board.

By arranging the trigger circuit unit according to the present invention to use the PLL circuit in place of the filter circuit, the light emitting member or the like can be operated while exhibiting modulation with respect to a specific frequency.

Although the invention has been described in its preferred form with a certain degree of particularly, it is understood that the present disclosure of the preferred form has been changed in the details of construction and the combination and arrangement of parts may be resorted to without departing from the spirit and the scope of the invention as hereinafter claimed.

What is claimed is:

1. A trigger circuit for operating mechanisms in synchronization with music, said trigger circuit comprising:

a forward circuit block comprising, a microphone for picking up audible musical signals originating from a source remote from said trigger circuit and for converting said picked up signals into electrical signals, a filter circuit for selecting a predetermined frequency band from said electrical signals, and a limit amplifier circuit comprising an inverter operation logic integrated circuit for amplifying said selected electrical signals and for transmitting an output having a predetermined amplitude; and a waveform conversion circuit block comprising, a time constant circuit connected to the output of said forward circuit block comprising a capacitor connected in series with at least one diode and a resistor in order to prevent backflow and to obtain a forward directional voltage difference, said time constant circuit being arranged to convert said amplified electrical signals into analog pulse signals with amplitudes greater than a predetermined level, the level obtained from said forward directional voltage difference, said time constant circuit further comprising a Schmidt circuit having a predetermined degree of hysteresis for converting said analog pulse signals into rectangular pulse signals before they are transmitted, whereby said rectangular pulse signals transmitted from said waveform conversion circuit block are basic trigger signals that correspond to said audible musical signals for operating said mechanisms.

2. The trigger circuit according to claim 1, further comprising decoding means for converting said basic trigger signals into a plurality of corresponding signals, each for operating one of a plurality of said mechanisms in synchronization with said audible musical signals.

3. The trigger circuit according to claim 2, further comprising an electric power amplifying circuit for transmitting said basic trigger signals so as to directly operate said mechanisms.

4. The trigger circuit according to claim 2, further comprising a battery as the power supply for said trigger circuit and wherein said mechanisms comprise LEDs.

5. The trigger circuit according to claim 1, further comprising an electric power amplifying circuit for transmitting said basic trigger signals so as to directly operate said mechanisms.

6. The trigger circuit according to claim 1, further comprising one of a small button battery and a lithium battery as the power supply for said trigger circuit and wherein said mechanisms comprise LEDs.

7. The trigger circuit of claim 1 wherein said limit amplifier circuit comprises a C-MOS type integrated circuit with one input line.

8. A trigger circuit for operating mechanisms in synchronization with music and light, said trigger circuit comprising:

means for picking up audible musical signals and for converting said picked up signals into electrical signals having a predetermined amplitude;

a time constant circuit connected to the output of said picking up means for obtaining a forward directional voltage difference, said time constant circuit being arranged to convert said electrical signals into analog pulse signals with amplitudes greater than a predetermined level, said predetermined level being obtained from said forward directional voltage difference; and a photoelectric conversion circuit for providing a signal in response to receipt of light flashes, the signal from said photoelectric conversion circuit being mixed with the output from said means for picking up so that said mechanisms may be operated in response to music and light.

9. The trigger circuit according to claim 8, wherein said trigger circuit is integrally mounted on a single printed circuit board.

10. The trigger circuit according to claim 9, further comprising a battery as the power supply for said trigger circuit and wherein said mechanisms comprise LEDs.

11. A trigger circuit responsive to an external audible sound and for generating signals corresponding to the sound that cause an observable response in a mechanism, said trigger circuit comprising:

pickup means for detecting said external audible sound and converting the detected sound into analog electrical signals;

filter means for attenuated predetermined frequencies in said analog signals;

amplifier means for amplifying said filtered analog signals so that each has at least a predetermined strength;

conversion means for converting said amplified analog signals into digital signals of sufficient strength to actuate a mechanism in synchronization with said sound detected by said pickup means;

decoder means for converting said digital signals into operating signals that are provided to the mechanism in synchronization said external audible sound; and means for detecting ones of said digital signals and corresponding ones of said operating signals and for stopping said corresponding operating signals unless both said digital signals and said corresponding operating signals are detected.

12. The trigger circuit according to claim 11 wherein said means for detecting comprises means for calculating a logical product of one of said digital signals and one of said corresponding operating signals so that the one said corresponding operating signal is provided to a corresponding said mechanism only when one of said digital signals is present.

13. The trigger circuit according to claim 12, further comprising a battery as the power supply for said trigger circuit and wherein said mechanism comprises an LED.

14. The trigger circuit of claim 11 wherein said filter means attenuates frequencies below 100 Hz and above 800 Hz.

15. The trigger circuit of claim 14 wherein said digital signals have a duration of about 50 ms to 200 ms.

16. The trigger circuit of claim 11 wherein said pickup means comprises a piezoelectric device for improved detection of external audible sound below about 1 kHz.

17. The trigger circuit of claim 11 further comprising a printed circuit board substrate for carrying said filter means, said amplifier means, said conversion means, said decoder means, and said means for detecting.

18. The trigger circuit of claim 17 wherein said substrate is no larger than about 10 mm by 10 mm.

19. The trigger circuit of claim 11 wherein said decoder means comprises a read only memory.

20. The device of claim 11 wherein said filter means comprises a capacitor and a resistor.

21. The device of claim 11 wherein said filter means comprises a phase lock loop circuit.

22. A trigger circuit responsive to an external audible sound and to light and or generating signals corresponding to the sound and light that cause an observable response in a mechanism, said trigger circuit comprising:

pickup means for detecting said external audible sound and converting the detected sound into analog electrical signals;

filter means for attenuating predetermined frequencies in said analog signals;

amplifier means for amplifying said filtered analog signals so that each has at least a predetermined strength;

conversion means for converting said amplified analog signals into digital signals of sufficient strength to actuate a mechanism in synchronization with said sound detected by said pickup means; and light detection means for detecting the presence of light to thereby cause operation of a mechanism in synchronization therewith.

23. The trigger circuit according to claim 22, further comprising decoding means for converting said digital signals into a plurality of corresponding signals, each for operating one said mechanism in synchronization with said audible sound.

24. The trigger circuit of claim 23 further comprising means for calculating a logical product of one of said digital signals and one of said corresponding signals so that the one said corresponding signal is provided to one said mechanism only when one of said digital signals is present.

25. The trigger circuit of claim 22 wherein said filter means comprises a capacitor and a resistor.

26. The trigger circuit of claim 22 wherein said filter means comprises a phase lock loop.

27. A device for preventing continuous activation of one or more mechanisms that have been activated by digital electrical signals synchronously derived from an audible musical sound wherein the digital electrical signals are not stopped when the sound stops, the device comprising;

means for detecting said audible musical sound having frequencies of about 100 to 800 Hz and for converting the detected sound into an analog electrical signal;

means for converting said analog electrical signal into a digital electrical signal of a predetermined amplitude and duration;

decoder means for converting said digital electrical signal into plural operational signals that activate said mechanisms in synchronization with said audible musical sound; and comparison means for detecting said operational signals and said digital electrical signal and for interrupting said operational signals when said digital electrical signal is not detected, whereby said mechanisms are deactivated when the music stops.

28. The device according to claim 27 further comprising a photoelectric conversion circuit for providing a signal to said means for converting in response to receipt of light flashes, the output of said photoelectric conversion circuit being mixed with the output from said means for detecting so that said mechanisms may be activated by signals derived from light.

* * * * *